US012063955B2

(12) United States Patent
Chempinsky et al.

(10) Patent No.: US 12,063,955 B2
(45) Date of Patent: Aug. 20, 2024

(54) SYSTEMS AND METHODS FOR TUBE LOADING, FILLING, SEALING, AND/OR WEIGHING

(71) Applicant: PT Mitra Prodin, Bali (ID)

(72) Inventors: Victor Chempinsky, Vancouver (CA); Oleksandra Barsukova, Dnipro (UA); Nikolai Bohun, Dnipro (UA); Konstantin Bohun, Dnipro (UA)

(73) Assignee: PT Mitra Prodin, Bali (ID)

( * ) Notice: Subject to any disclaimer, the term of this patent is extended or adjusted under 35 U.S.C. 154(b) by 58 days.

(21) Appl. No.: 17/386,322

(22) Filed: Jul. 27, 2021

(65) Prior Publication Data

US 2022/0022524 A1 Jan. 27, 2022

Related U.S. Application Data

(60) Provisional application No. 63/057,022, filed on Jul. 27, 2020.

(51) Int. Cl.

| | |
|---|---|
| ***A24C 5/02*** | (2006.01) |
| ***A24C 5/00*** | (2020.01) |
| ***A24C 5/34*** | (2006.01) |
| ***A24C 5/39*** | (2006.01) |
| ***A24C 5/54*** | (2006.01) |

(52) U.S. Cl.

CPC ..... *A24C 5/02* (2013.01); *A24C 5/002* (2013.01); *A24C 5/3424* (2013.01); *A24C 5/393* (2013.01); *A24C 5/54* (2013.01)

(58) Field of Classification Search

CPC ..... A24C 5/02; A24C 5/002; A24C 5/3424; A24C 5/393; A24C 5/54

See application file for complete search history.

(56) References Cited

U.S. PATENT DOCUMENTS

| | | | | |
|---|---|---|---|---|
| 2016/0120212 | A1* | 5/2016 | Heidtmann | A24C 5/02 |
| 2019/0320708 | A1* | 10/2019 | Boucher et al. | A24C 5/06 |
| 2020/0345061 | A1* | 11/2020 | Veelo et al. | A24C 5/06 |

FOREIGN PATENT DOCUMENTS

| | | | | |
|---|---|---|---|---|
| WO | WO 2019/092477 A1 * | 5/2019 | | A24C 5/02 |

* cited by examiner

*Primary Examiner* — Christopher M Rodd
*Assistant Examiner* — Ronnie Kirby Jordan
(74) *Attorney, Agent, or Firm* — FINNEGAN, HENDERSON, FARABOW, GARRETT & DUNNER LLP

(57) ABSTRACT

A tube loading, filling and sealing system that includes a tube loading apparatus, a tube filling apparatus, a tube sealing apparatus configured to receive and seal a plurality of tubes, and a weighing apparatus configured to weigh a plurality of filled tubes. A method of filling tubes with a herb mixture using a tube loading, filling, and sealing system. The method including loading the tubes into a tube filling apparatus using a tube loading apparatus, filling the tubes loaded into the tube filling apparatus with a herb mixture, sealing the filled tubes using a tube sealing apparatus, and weighing the sealed tubes using a weighing apparatus.

20 Claims, 36 Drawing Sheets

SYSTEMS AND METHODS FOR TUBE LOADING, FILLING, SEALING, AND/OR WEIGHING

CROSS REFERENCE TO RELATED APPLICATIONS

This application claims priority to U.S. Provisional Application No. 63/057,022, filed Jul. 27, 2020, which is incorporated herein by reference in its entirety.

TECHNICAL FIELD

The disclosure relates generally to a system that includes a cone/tube loading apparatus, a cone/tube filling apparatus, a cone/tube sealing apparatus, and a cone/tube weighing apparatus. In particular, but not exclusively, the invention relates to an apparatus for loading, filling, sealing, and/or weighing pre-rolled paper cones/tubes with processed plant material, such as a herb mixture, for example.

BACKGROUND

Paper, cellulose or hemp cones/tubes are often filled by processed plant material, such as an herb mixture, to allow it to be set alight so that it can be smoked. Traditionally, pre-rolled cones and tubes have been filled manually by inserting an amount of herb mixture into the cone/tube and thereafter compacting the mixture by striking it on a hard surface until a desired density is obtained. This manual process of filling cones/tubes typically takes about two to three minutes, depending on the quantity, quality and density of the fill required. Manual filling processes may thus include certain drawbacks, such as increased filling time and difficulty achieving a desired density.

Accordingly, there exists a need for improved systems and methods for pre-rolled cone and tube loading, filling, sealing, and/or weighing as disclosed herein.

SUMMARY

Embodiments of the present disclosure may provide a cone/tube processing system. It is noted that embodiments of the current disclosure are adapted for processing both cones and tubes. To avoid repetition, any recitation of a "tube" or "tubes" in the present disclosure are defined to also encompass a "cone" or "cones" unless explicitly stated otherwise. The tube processing system may include a tube loading apparatus. The tube loading apparatus may include a frame, an upper slider connected to the frame, a lower slider connected to the frame, one or more guide tubes extending between the upper slider and the lower slider, and at least one actuator configured to control the positions of the upper slider and the lower slider. The tube processing system may include a tube filling apparatus connected to the tube loading apparatus. The tube filling apparatus including a base and a filling assembly connected to the base. The filling assembly may include a plurality of tube recesses each configured to receive one or more tubes from the tube loading apparatus, a vibration plate positioned between the base and the filling assembly and configured to move independently from the tube filling system. The tube processing system may include a tube sealing apparatus connected to the tube filling apparatus. The tube sealing apparatus may include a tube holder module including a plurality of openings, each opening surrounded by one or more flanges, and a tube closing module including a plurality of seal chambers configured to receive and seal at least one of the one or more tubes. The tube processing system may further include a weighing apparatus connected to the tube holder module of the tube sealing apparatus, the weighing apparatus configured to weigh the one or more tubes.

In some embodiments, the guide tubes, the tube recesses, and the plurality of openings in the tube holder module are aligned to pass the one or more tubes therebetween.

Embodiments of the present disclosure provide a tube loading system. The tube loading system can be manual, semi-manual, and/or motorized/fully automated. The tube loading system may include a frame, an upper slider and a lower slider, the upper and lower sliders connected to the frame, one or more guide tubes extending between the upper slider and lower slider, at least one actuator connected to the upper slider and the lower slider and configured to control movement of the upper slider and the lower slider to position the upper slider and the lower slider between a first position and a second position. In the first position, the upper slider is in an open position and the lower slider is in a closed position, and in the second position, the upper slider is in a closed position and the lower slider is in an open position.

In some embodiments, the at least one actuator is pivotably connected to the frame. Rotational movement of the actuator may move the upper slider and the lower slider between the first position and the second position.

Embodiments of the present disclosure may provide a tube sealing system. The tube sealing system can be manual, semi-manual, and/or motorized/fully automated. The tube sealings system includes a tube holder module, the tube holder module including an upper plate and a lower plate separated by one or more spacers, a plurality of openings in the upper plate, a plurality of flanges surrounding the plurality of openings in the upper plate, the plurality of flanges having an open position that allows tubes to be loaded into the openings and a closed position that holds loaded tubes in the openings. The tube sealing system may include a tube closing module that includes one or more seal chambers, each seal chamber having one or more teeth and a drive member, one or more gear racks configured to contact each drive member and rotate the drive member thereby rotating the teeth of each seal chamber.

In some embodiments, the one or more gear racks concurrently rotates each of the one or more drive chambers to concurrently seal a plurality of tubes.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this disclosure, illustrate exemplary embodiments and, together with the description, serve to explain the disclosed principles.

DETAILED DESCRIPTION

As discussed in further detail below, embodiments of the present disclosure may provide systems that may fill tubes, seal filled tubes, and weigh the filled and sealed tubes. The term "tube" as used throughout this specification is used in a broad sense to describe both cylindrical and conical holders wherein processed plant material, such as an herb mixture, for example, can be received. The tubes may be paper, cellulose or hemp tubes, with an herb mixture, which may be smoked.

Presently disclosed embodiments may offer advantages over methods and devices that do not allow for the simultaneous filling of multiple paper tubes or for the compacting of the herb mixture to a satisfactory degree. Certain embodiments may also provide for simultaneous sealing of multiple tubes at a time and/or for in-line weight verification of multiple tubes during the production process. Presently disclosed embodiments may also reduce or eliminate the likelihood that the herb mixture will need to be compacted further manually after having removed the paper tubes from the devices in order to get a satisfactory herb mixture density. Furthermore, some embodiments may provide for the loading, filling, sealing, and/or weighing of multiple tubes.

Figure 1:
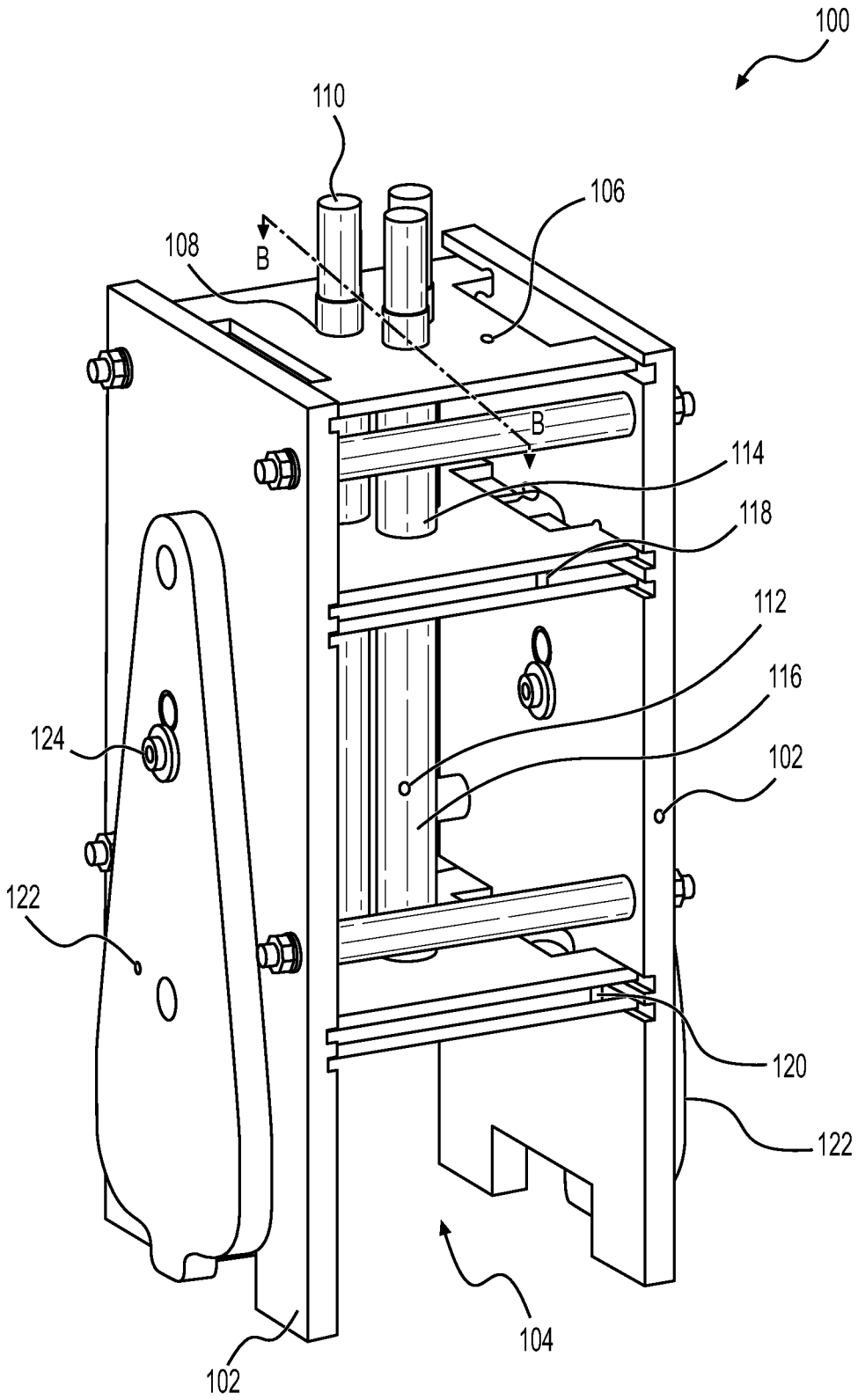
FIG. 1 illustrates a front, top perspective view of a tube loading system, consistent with embodiments of the present disclosure.

Turning now to the drawings, FIG. 1 illustrates a tube loading system 100 consistent with embodiments of the present disclosure. Tube loading system 100 may provide the automated loading of tubes into a tube filling system, a cone sealing system, and a cone weighing system.

Tube loading system 100 may include a frame 102 that may include two opposing sidewalls spaced apart from each other that creates an inner chamber 104. Tube loading system 100 may further include a thrust plate 106 positioned at or near a top end of tube loading system 100. Thrust plate 106 may extend between the frame 102 walls and may include one or more openings 108 configured to receive one or more tubes 110. In some embodiments, the openings may be arranged in a triangular pattern through thrust plate 106, and each opening 108 may receive a vertical stack of a plurality of tubes 110. While three openings 108 are illustrated in FIG. 1, it is to be appreciated that any suitable number of openings 108 may be implemented in tube loading system 100.

The openings 108 may be aligned with and may connect to one or more guide tubes 112 that extend downwardly away from thrust plate 106 and may receive the tubes 110 received through openings 108. The guide tubes 112 may be separated into an upper section 114 and a lower section 116. The upper section 114 may be positioned between thrust plate 106 and an upper slider 118 that extends between the frame 102 walls below thrust plate 106. The lower section 116 may be positioned between upper slider 118 and a lower slider 120 that is positioned below and spaced apart from upper slider 118. The upper slider 118 and the lower slider 120 may extend between the frame 102 walls and may be connected to an actuator 122 that may be positioned outside of the frame 102 walls. In some embodiments, actuator 122 may extend from, at, or slightly above the vertical position of the upper slider 118 to below the vertical position of the lower slider 120. In some embodiments, the actuator 122 may extend to or below a bottom surface of the frame 102. Tube loading system 100 may include two actuators 122, with an actuator 122 positioned outside of each frame 102 wall. Actuator 122 may be connected to the frame 102 at a pivot point 124 from which actuator 122 rotates. Rotation of actuator 122 controls the respective positions of the upper slider 118 and lower slider 120. The positions of actuator 122 will be described in more detail with respect to FIGS. 2A through 3D.

Figure 2A:
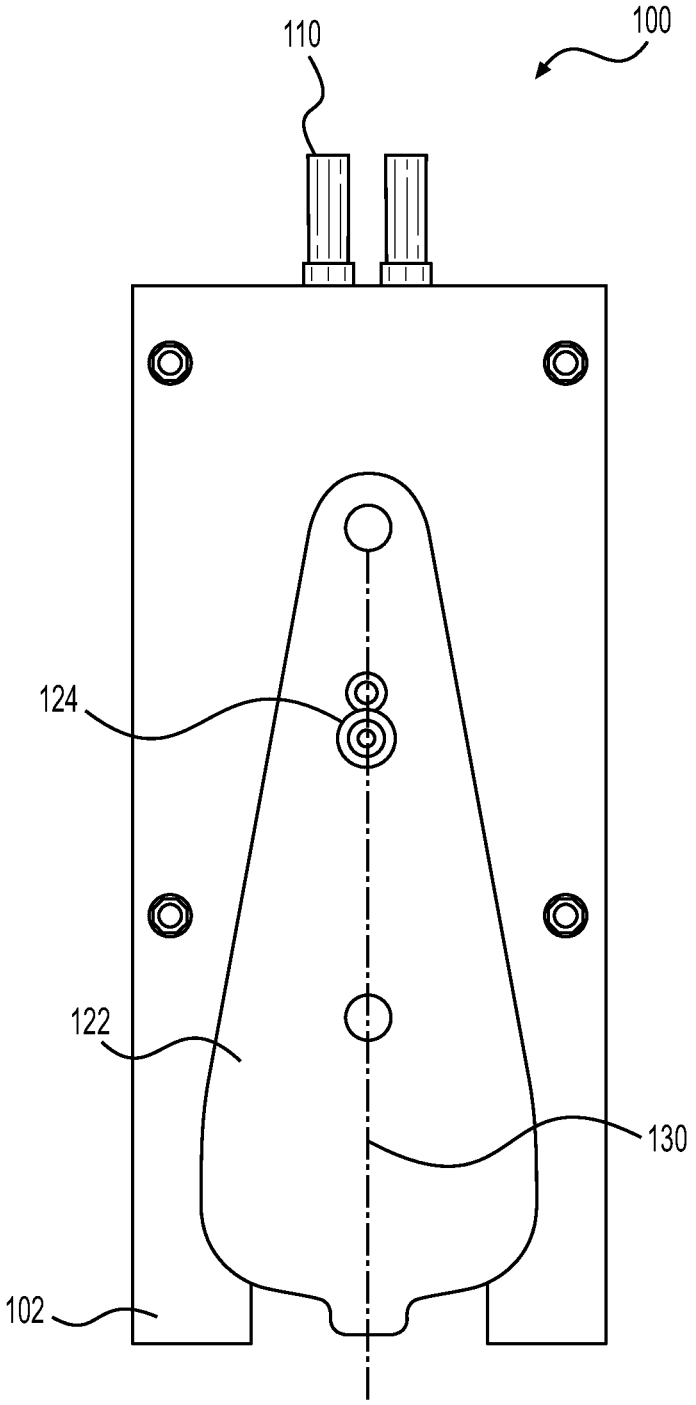
FIG. 2A illustrates a left side view of the tube loading system of FIG. 1 in a first position, consistent with embodiments of the present disclosure.

FIG. 2A illustrates tube loading system 100 having the actuator 122 in a vertical position that may be obtained when actuator 122 is positioned vertically such that an axis 130 of actuator 122 is positioned vertically (i.e., in a vertical position aligned with a Y-axis).

Figure 2C:
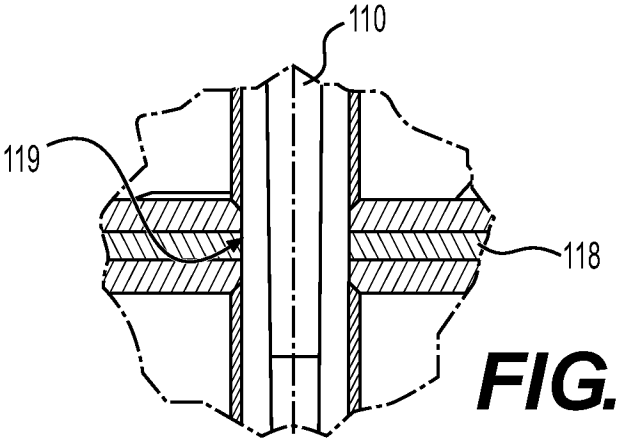
FIG. 2C shows a detailed view of section 2C in FIG. 2B, consistent with embodiments of the present disclosure.
Figure 2D:
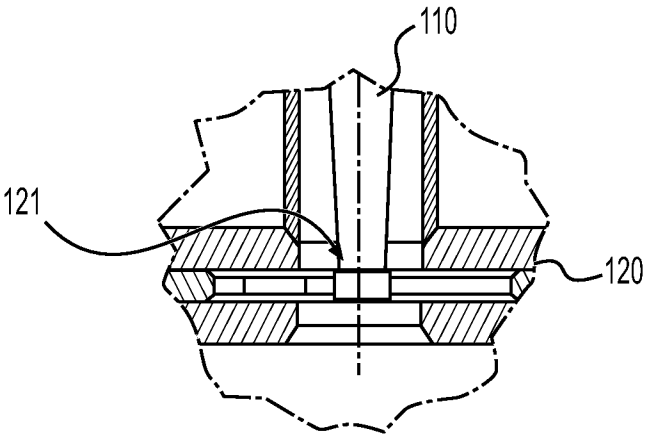
FIG. 2D shows a detailed view of section 2D in FIG. 2B, consistent with embodiments of the present disclosure.
Figure 2B:
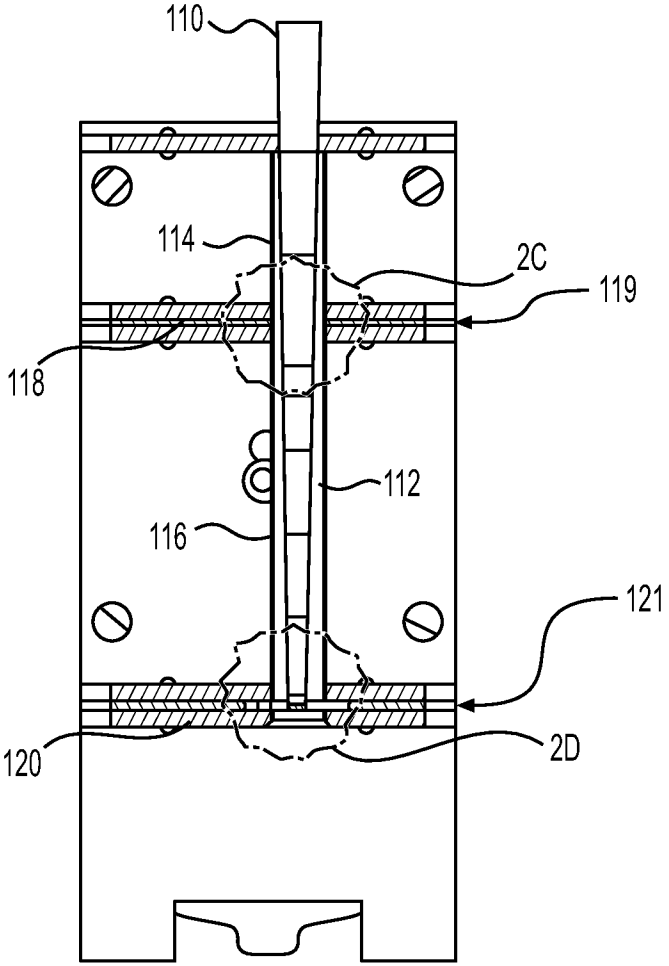
FIG. 2B illustrates a cross sectional view along the B-B cross-section line of FIG. 1, with the tube loading system in the first position, consistent with embodiments of the present disclosure.

FIGS. 2B, 2C, and 2D illustrate the positioning of upper slider 118 and lower slider 120 when actuator 122 is in the vertical position. More specifically, FIG. 2B illustrates a cross sectional view along the B-B cross-section line of FIG. 1, with the tube loading system in the first position. FIG. 2C shows a detailed view of section 2C in FIG. 2B. FIG. 2D shows a detailed view of section 2D in FIG. 2B. A valve open position is illustrated by arrow 119. A valve closed position is illustrated by arrow 121.

With actuator 122 in the vertical position, the upper slider 118 may be in an open position that allows one or more tubes 110 to fall through the upper slider 118, while the lower slider 120 may be in a closed position that prevents tubes 110 from falling past the lower slider 120. In the vertical position of actuator 122, tubes 110 may pass through upper portion 114 of guide tubes 112 and may be stopped and positioned in lower portion 116 of guide tubes 112.

Figure 3A:
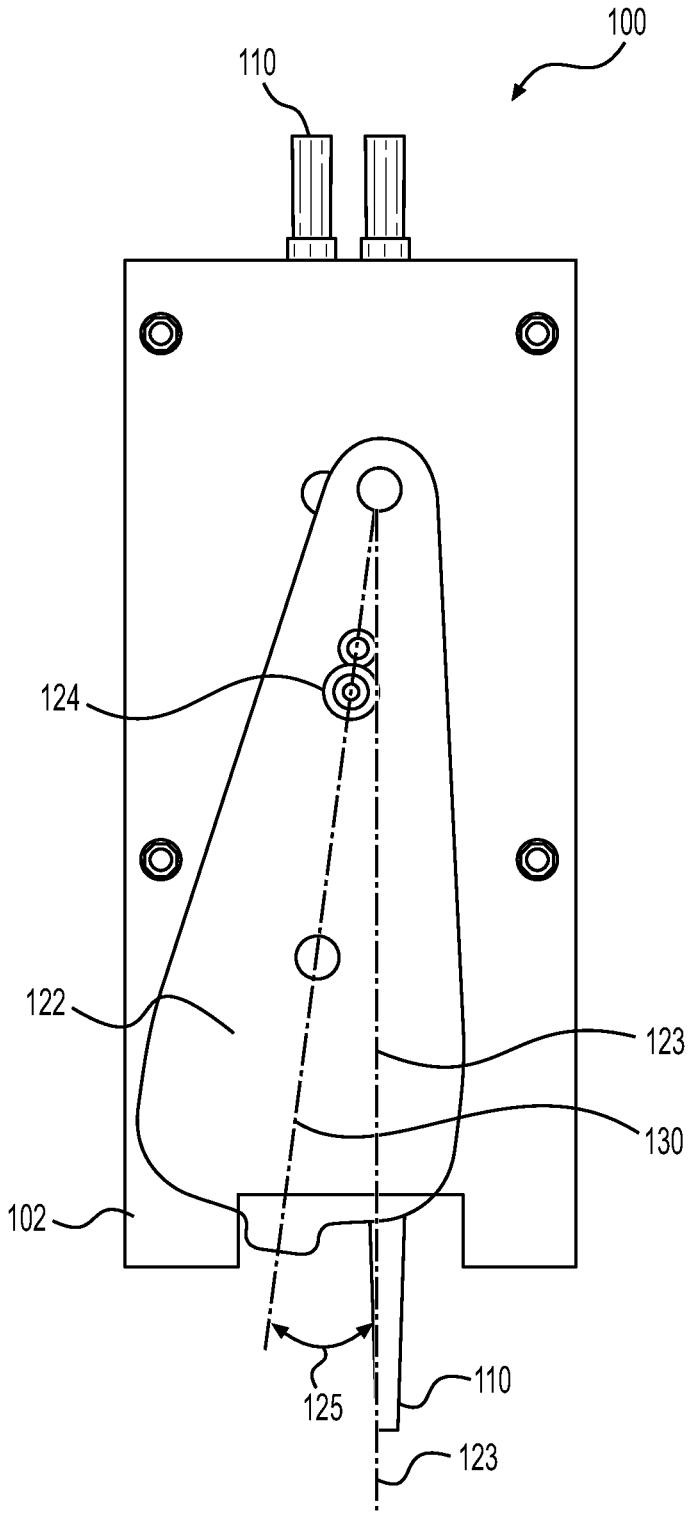
FIG. 3A illustrates a left side view of the tube loading system of FIG. 1 in a second position, consistent with embodiments of the present disclosure.

FIG. 3A illustrates tube loading system 100 having the actuator 122 in an angled position that may be obtained when actuator 122 is positioned at an angle such that axis 130 of actuator 122 is positioned at an angle 125 offset from a vertical axis 123.

Figure 3C:
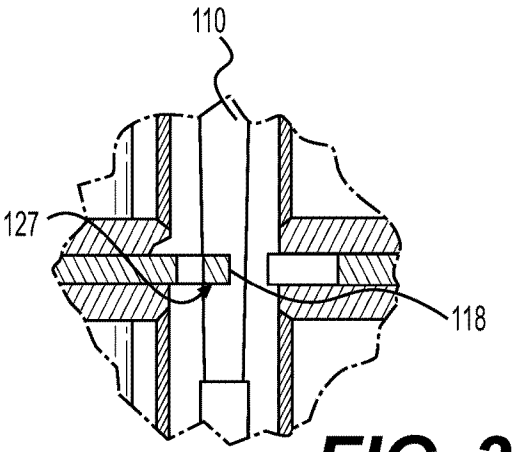
FIG. 3C shows a detailed view of section 3C in FIG. 3B, consistent with embodiments of the present disclosure.
Figure 3D:
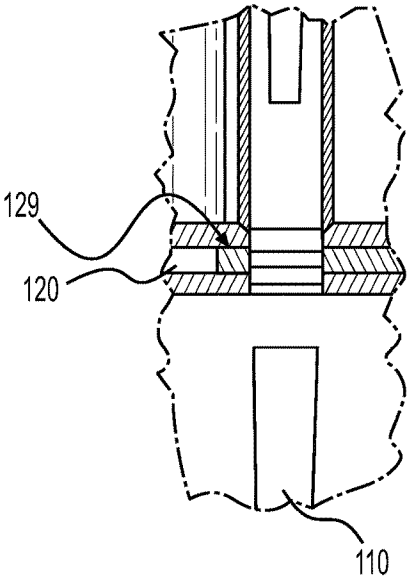
FIG. 3D shows a detailed view of section 3D in FIG. 3B, consistent with embodiments of the present disclosure.
Figure 3B:
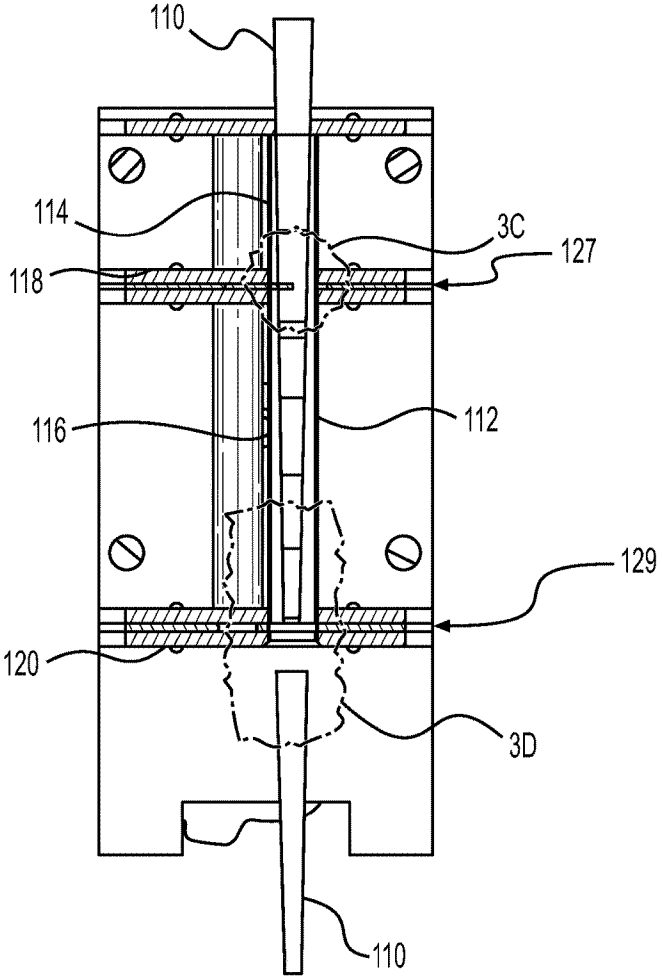
FIG. 3B illustrates a cross sectional view along the B-B cross-section line of FIG. 1, with the tube loading system in the second position, consistent with embodiments of the present disclosure.

FIGS. 3B, 3C, and 3D illustrate the positioning of upper slider 118 and lower slider 120 when actuator 122 is in the angled position. Specifically, FIG. 3B illustrates a cross sectional view along the B-B cross-section line of FIG. 1, with the tube loading system in the second position. FIG. 3C shows a detailed view of section 3C in FIG. 3B. FIG. 3D shows a detailed view of section 3D in FIG. 3B.

With actuator 122 in the angled position, the upper slider 118 may be in a valve closed position 127 that does not allow additional tubes 110 to fall through the upper slider 118, while the lower slider 120 may be in a valve open position 129 that allows tubes 110 to fall past the lower slider 120, and exit the tube loading system 100. In the angled position of actuator 122, additional tubes 110 may not pass through upper portion 114 of guide tubes 112 and may be pass through lower portion 116 of guide tubes 112 and exit tube loading system 100.

Accordingly, when the actuator 122 is deflected about pivot point 124, the lower slider 120 is actuated into an open position. In some embodiments, concurrently, the upper slider 118 is moved into the closed position and captures the next tube 110. The open position of the bottom slider 120 releases the tube 110 previously occupying the lower portion 116, thereby releasing the tube 110 to the tube filling apparatus. The tube loading apparatus 100 may provide empty tubes 110 to a tube filling apparatus (e.g. tube filling apparatus 310 shown in FIG. 9) for filling the tubes 110 with an herb mixture.

In some embodiments, tube loading system 100 may further include deflectors. The deflectors may be positioned in line with the upper slider 118 and the lower slider 120. More specifically, the deflectors may be positioned near openings 108 in guide tubes 112. For example, a deflector may be positioned at each opening 108 along the guide tubes 112. In certain embodiments the deflectors may be positioned at each opening 108 along the lower slider 120. In some embodiments, the deflectors may include brushes. Each brush may be connected to a motor, where each brush extends from an end of a motor axis. In some embodiment, each motor may be connected to a dedicated power source. In certain embodiments, each motor may be connected to the same power source as one or more other motors. The power source(s) may enable the motors to rotate which may cause the brushes at the end of each motor axis to rotate.

In some embodiments, the brushes may contact tubes 110, and the rotating brush contacting the tube 110 may move the tube 110. For example, the tubes 110 may be in a stack of tubes 110 where there may be friction between the tubes 110 that are stacked together. The rotation of the brush along a bottom-most tube 110 may provide a downward directional force that overcomes the frictional connection between the bottom-most tube and the tube stacked on top of the bottom-most tube. Accordingly, the bottom-most tube may be released to the tube filling apparatus while the remaining stack of tubes 110 is retained in the tube loading system 100.

In some embodiments, the tube filling apparatus may include a base 340, a filling assembly 320 mountable on the base 340, the filling assembly having a number of tube receiving recesses 322 wherein tubes may be received, a vibration plate 332 positioned between the base 340 and the filling assembly 320 so the tubes may rest on the vibration plate 332 when they are positioned in the recesses 322, and a vibration member which is in connection with the vibration plate 332 for vibrating the vibration plate 332. The vibration plate is capable of moving independently from the filling assembly. "Move independently" may refer to the vibration plate 332 moving (i.e. vibrating) while the filling assembly 320 remains stationary (i.e. does not vibrate). The vibration plate 322 may include a transducer, such as a speaker for example, for transferring oscillating electro-mechanical energy to the vibration plate 322. The speaker may be connected to the vibration plate 322 by means of a coupling element which connects a speaker cone of the speaker to the vibration plate 322 so that the vibration of the speaker cone is, in use, transferred to the vibration plate 322, thereby vibrating the tubes 110 resting on the vibration plate 322. In one embodiment the vibrating means includes three speakers, each being connected to the vibration plate 322 by means of a coupling element. In other embodiments, more than three speakers (e.g., nine speakers) may be used.

The filling assembly 320 may be removably attachable to the base 340 at a fixed height above the base 340 by means of supports, thereby allowing the filling assembly 320 to be removed from the base 340. The filling assembly 320 may be magnetically attachable to the base 340.

The filling assembly 320 may include a lower assembly and an upper assembly, which is, in use, mounted removably on top of the lower assembly, wherein the upper and lower assemblies have a number of tube receiving recesses, and wherein the tube receiving recesses in the upper assembly align with the recesses in the lower assembly when mounted on the lower assembly.

The filling assembly 320 may be height adjustable with respect to the base 340 in order to adjust the distance between the lower assembly and the vibration plate located between the lower assembly and the base, thereby facilitating the extraction of filled tubes after the filling process has been completed. For example, the filling assembly 320 may be mounted on the base by means of adjustable pillars.

Each of the upper and lower assemblies may include a top support, a bottom support and a series of receptacles running between the top and bottom supports, wherein the receptacles define the tube receiving recesses 322 in which the tubes are, in use, received.

The apparatus may further include a filling tray being connectable to the upper assembly in a position wherein it is, in use, located above the upper assembly, wherein the filling tray includes recesses which correspond with the recesses 322 in the upper assembly when mounted thereon.

Yet further, the apparatus may include a sliding plate being receivable between the filling tray and the upper assembly so as to block off the recesses in the filling tray from the recesses 322 in the upper assembly. The sliding plate may be removable so as to allow it to be removed after the recesses in the filling tray have been filled with the herb mixture. In some embodiments, this feature may enable the herb mixture to fall into the tubes 110 inside the filling assembly 320 upon removal of the sliding plate.

The apparatus may also include a fan blower 356 mounted in a fan housing having a body, which is connected to the base 340, and a cover for directing the airflow over the vibration plate 322. The cover may be removably connectable to the fan housing body so that it can be removed to allow access to the fan blower. The fan housing cover may be magnetically coupled to the fan housing.

The apparatus may further include a collector tray being connected to the base 340 on the side of the base which is opposite to the side to which the fan housing is connected. The foregoing feature may allow the excess herbal mixture to be blown off the vibration plate and into the collector tray. The collector tray may be removably connectable to the base so that herb mixture collected therein can be re-used. The collector tray may be reversible, i.e., capable of being re-attached to the base in an orientation which differs 180 degrees from its initial orientation, so that its floor creates a working surface when it is attached to the base in its reversed orientation.

Figure 4:
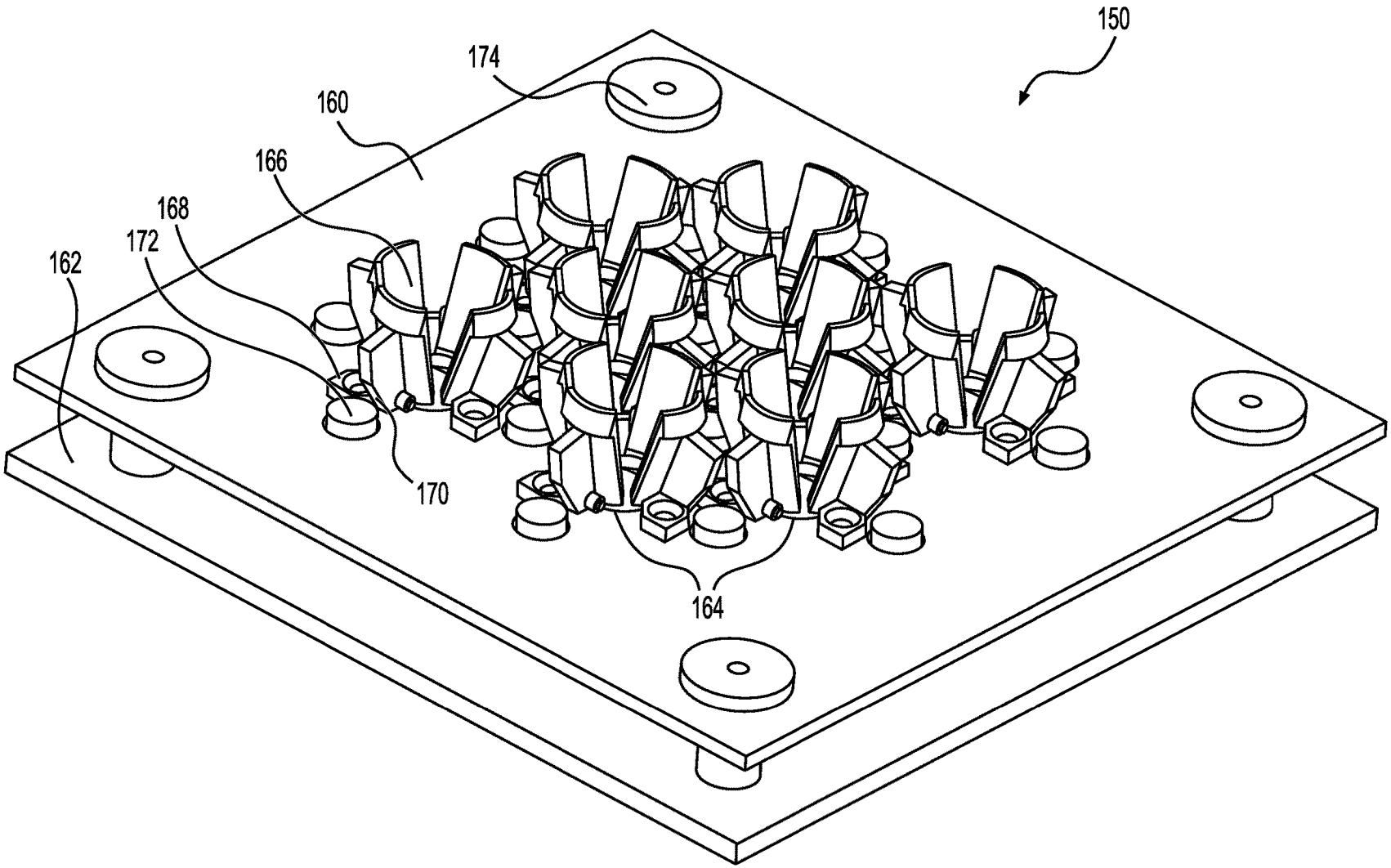
FIG. 4 illustrates a top right perspective view of a tube holding module of the tube sealing system in an open position, consistent with embodiments of the present disclosure.
Figure 5A:
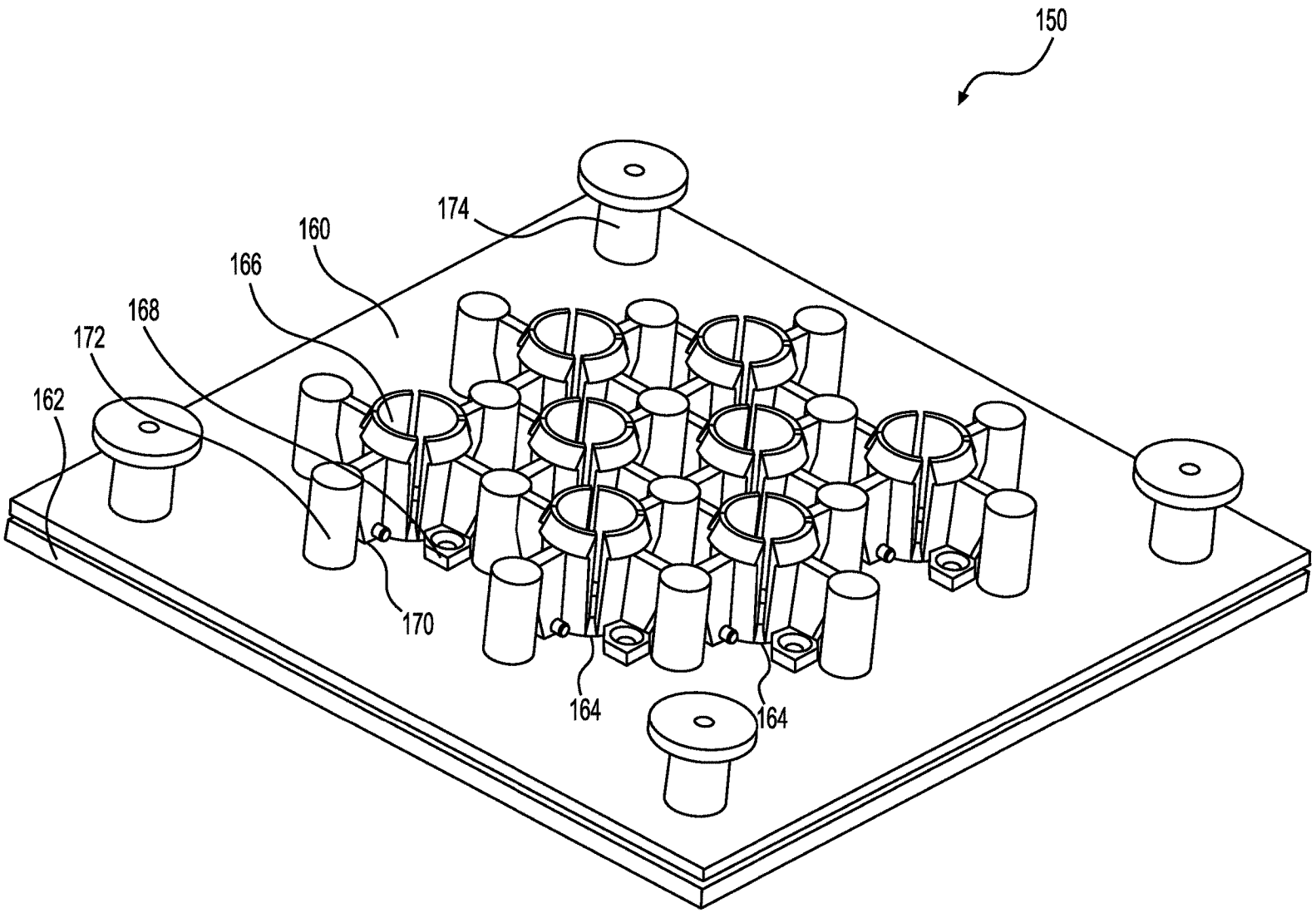
FIG. 5A illustrates a top right perspective view of the tube holding module of the tube sealing system of FIG. 4 in a closed position, consistent with embodiments of the present disclosure.
Figure 5B:
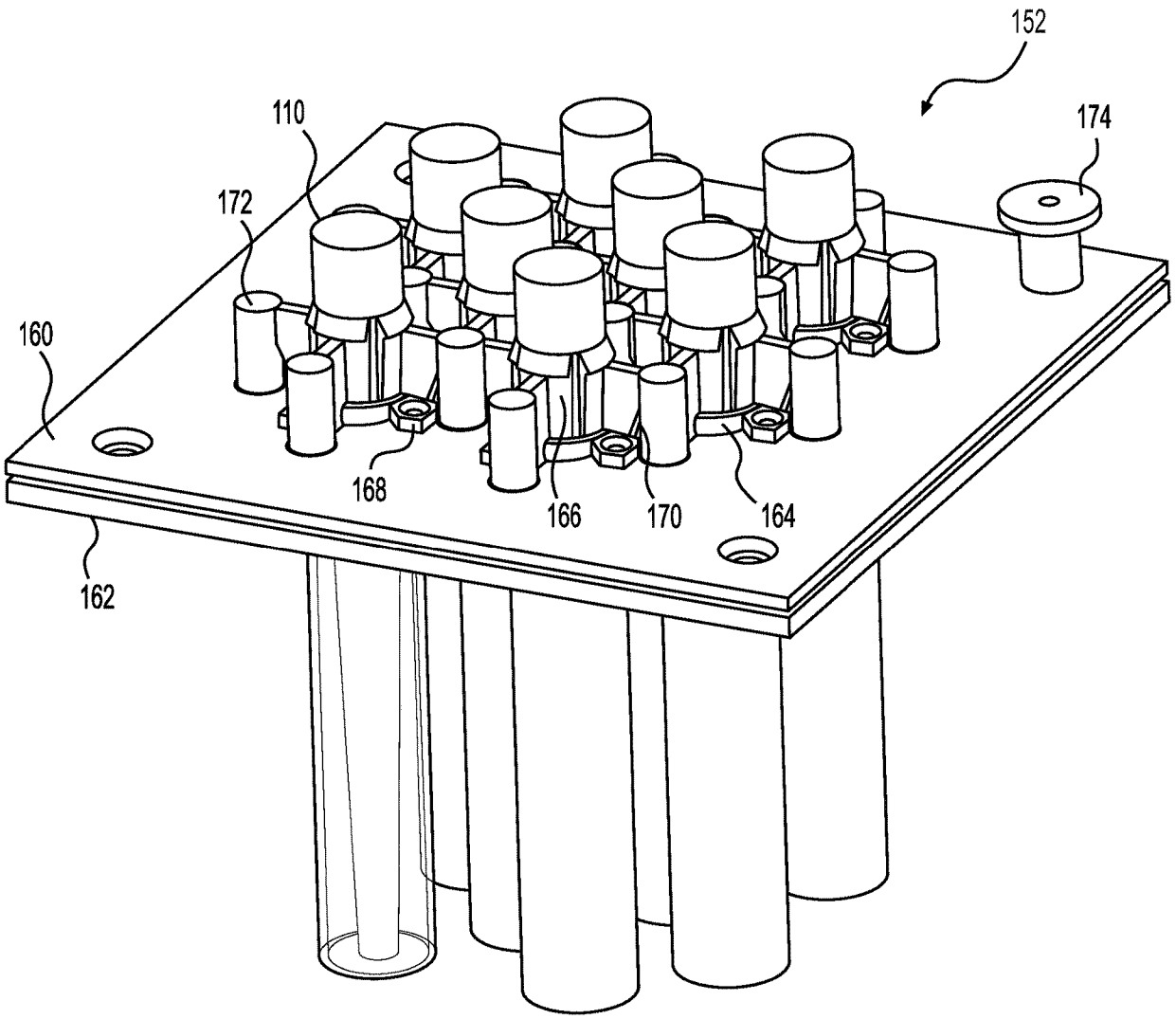
FIG. 5B illustrates a top right perspective view of the tube holding module of FIG. 5A with tubes inserted, consistent with embodiments of the present disclosure.

The tube filling apparatus may provide filled tubes 110 to a tube holder module 150. FIGS. 4, 5A, and 5B illustrate tube holder module 150 that may be a part of a tube sealing system 152 that may include the tube holder module 150 and a tube closing module 154.

The tube holder module 150 may include an upper plate 160 and a lower plate 162. The upper plate 160 and the lower plate 162 may each have one or more openings 164 that are configured to receive one or more tubes 110. The one or more openings 164 in the upper plate 160 and the lower plate 162 may be aligned such that a tube 110 may extend through each opening 164.

The upper plate 160 may have a plurality of flanges 166 connected to the upper plate 160 around each opening 164. The plurality of flanges 166 may each have a hinged connection 168 to the upper plate 160 such that each flange 166 can move between an open position (FIG. 4) and a closed position (FIGS. 5A and 5B) about an axis of the hinge connection 168. The flanges 166 may extend above the upper plate 160 and may be arranged around each opening 164 such that each opening 164 has a plurality of flanges 166. The flanges 166 may each be curved to match the curve of the opening 164. Although four flanges 166 are illustrated for each opening 164, it is to be appreciated that any suitable number of flanges 166 may be implemented depending on implementation-specific considerations.

Each flange 166 may include an angled surface 170 positioned on the opposite side of the flange 166 as opening 164. In some embodiments, the angled surface 170 may extend away from the flange 166 and may be narrowest at the base of flange 166 and widest at or near a midpoint of the flange 166.

The angled surface 170 of each flange 166 may be positioned near one of a plurality of columns 172 that extend from the lower plate 162 through the upper plate 160. The columns 172 may be positioned near the narrowest portion of the angled surface 170 so that during movement of the upper plate 160 towards the lower plate 162, the extension of the columns 172 vertically may contact the angled surfaces 170 of the plurality of flanges 160. The foregoing feature may enable actuation of the flanges 166 about the axis of each hinged connection 168, thereby placing the flanges 166 in the closed position illustrated in FIGS. 5A and 5B. The upper plate 160 and the lower plate 162 may be separated by spacers 174 positioned away from the plurality of openings 164. The spacers 174 may provide for open and closed positions of the tube holder module 150 by allowing the upper plate 160 and the lower plate 162 to change the space between each other without changing the alignment of the plurality of holes 164 in each plate.

The tube holder module 150 may have an open position as illustrated in FIG. 4 and a closed position as illustrated in FIGS. 5A and 5B.

FIG. 4 illustrates in the open position, lower plate 162 is positioned away from upper plate 160 and the spacers 174 hold the lower plate 162 away from the upper plate 160. In some embodiments, columns 172 do not contact angled surfaces 170 to cause the flanges 166 to close. Instead, in such embodiments, flanges 166 remain in the open position and can receive tubes 110 in the openings 164.

FIGS. 5A and 5B illustrate in the closed position, after tubes 110 are positioned in the openings 164, lower plate 162 may be moved into and fixed in an upper position adjacent to upper plate 160. The columns 172 may be positioned near the narrowest portion of the angled surface 170 so that during movement of the upper plate 160 towards the lower plate 162, the extension of the columns 172 vertically may contact the angled surfaces 170 of the plurality of flanges 166 and may actuate the flanges 166 about the axis of each hinged connection 168 thereby placing the flanges 166 in the closed position.

Figure 6:
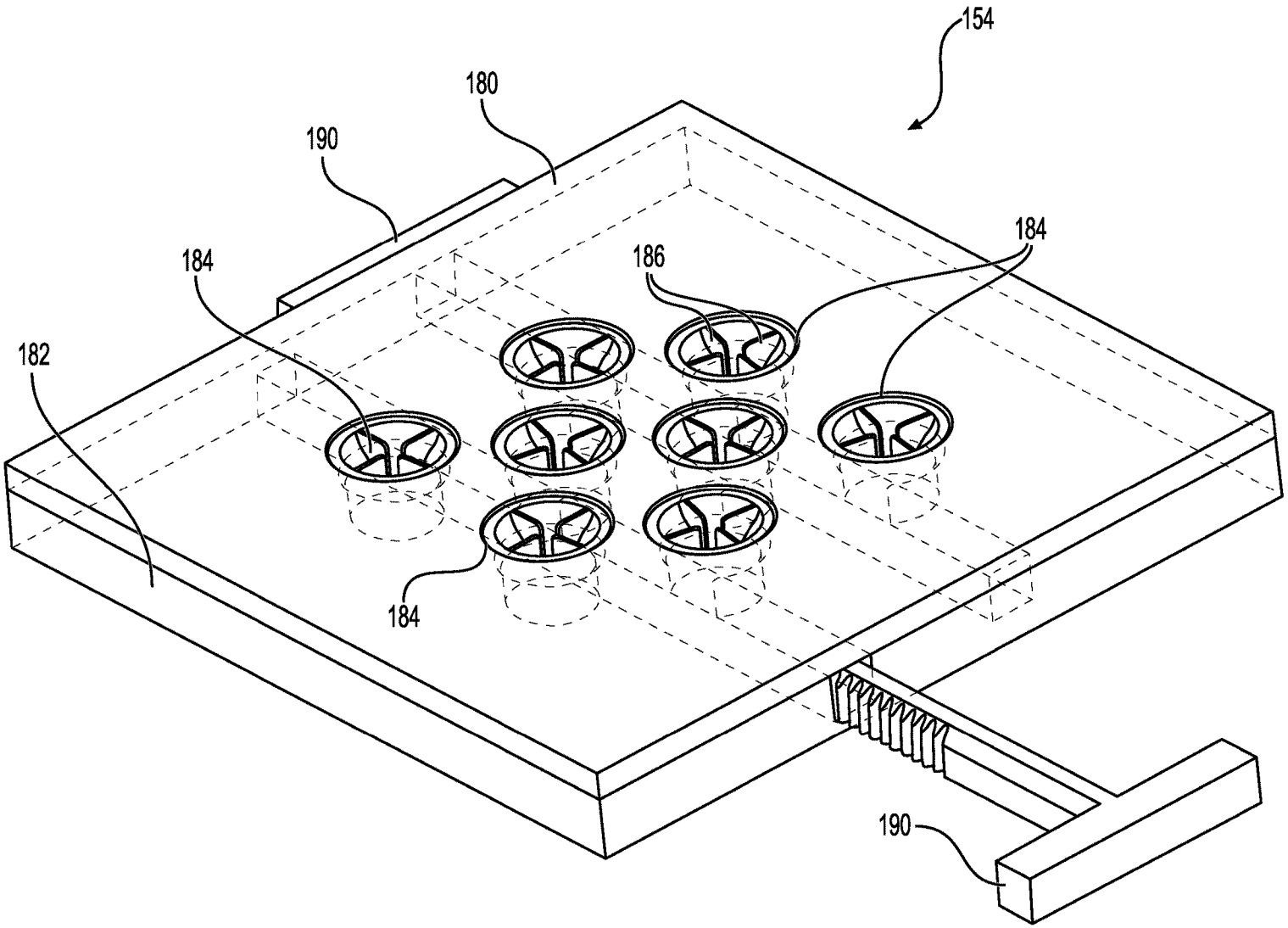
FIG. 6 illustrates a top right perspective view of a tube sealing module of the tube sealing system.
Figure 7:
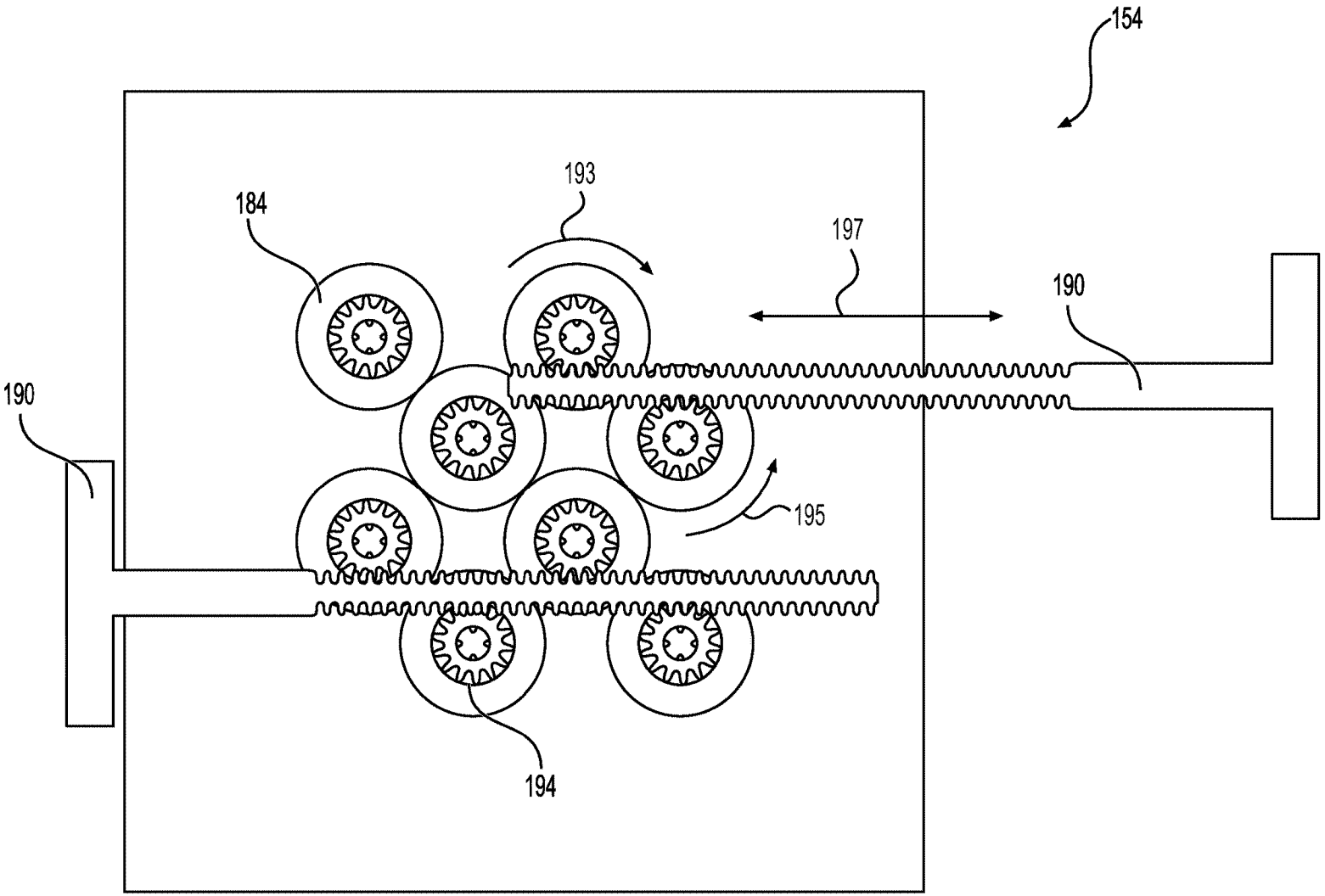
FIG. 7 illustrates a bottom view of the tube sealing module of FIG. 6, consistent with embodiments of the present disclosure.

FIGS. 6 and 7 illustrate the tube closing module 154 that may be a part of a tube sealing system 152. The tube sealing system 152 may include the tube holder module 150 and a tube closing module 154. In some embodiments, tube closing module 154 may be positioned above tube holder module 150 to complete tube sealing system 152.

Tube closing module 154 may include a seal plate 180 and a drive plate 182. Seal plate 180 may include one or more seal chambers 184, each seal chamber 184 including one or more teeth 186. The seal chambers 184 may be cylindrical and the teeth 186 may extend outwardly from a center of each chamber 184. As illustrated, each seal chamber 184 may include four teeth 186 spaced equidistant apart around the seal chamber 184. Although four teeth 186 are shown, it is to be appreciated that any suitable number of teeth 186 may be implemented and any suitable number of seal chambers 184 may be implemented.

Arrows 193, 195, and 197 illustrate directions of movement of the respective parts in one embodiment. Drive plate 182 may be configured to receive one or more gear racks 190 that extend into drive plate 182. Gear racks 190 may be moveable in and out of drive plate 182. Each seal chamber 184 may include a drive member 194.

Gear racks 190 may have a plurality of gear teeth on each side of the gear rack that may engage with one or more drive members 194 that may be positioned on opposite sides of the gear rack 190 so that gear rack 190 can engage and drive multiple drive members 194 concurrently. Each drive member 194 may be rotationally connected to the teeth 186 of each seal chamber 184. The rotation of the drive member 194 caused by the gear rack 190 may cause the teeth 186 to rotate.

In some embodiments, seal chambers 184 may be configured to receive an open end of tube 110. The rotation of teeth 186 caused by gear rack 190 may result in twisting of the open end of the tube 110, thereby sealing the tube 110. In other embodiments, the open end of tube 110 may be folded to be sealed (i.e., a Dutch Crown).

In some embodiments, the one or more gear racks 190 may concurrently rotate each of the one or more drive members 194 to concurrently seal the plurality of tubes 110. "Concurrently rotate" may refer to rotation more than one drive member 194 at a time, where gear rack 190 may rotate each drive member 194 with the movement of gear rack 190. For example, gear rack 190 may be in contact with more than one drive member 194 at a given position, and movement of gear rack 190 when gear rack 190 is in contact with more than one drive member 194 causes movement of each drive member 194 at the same time. In another example, if gear rack 190 is not in contact with drive member 194, movement of gear rack 190 will not cause rotation of drive member until contact between gear rack and drive member 194 occurs. "Concurrently seal" may refer to the sealing of a plurality of tubes 110 at the same time, where concurrent rotation of drive members 194 by gear rack 190 may twist or fold the tops of tubes 110 at the same time and the twisting of the top of tube 110 may close each tube 110 to provide a plurality of sealed tubes 110.

Embodiments of the present disclosure may further provide for weighing of tubes 110. Some embodiments may provide for weighing of individual tubes 110 after each tube has been filled. Other embodiments may provide for weighing of individual tubes 110 after each tube has been filled and sealed. Still other embodiments may provide weighing of a plurality of tubes 110 such as an array of tubes 110 concurrently or individually. The tube weighing system may be integrated within tube loading system 100 and/or tube sealing system 152 including tube holder module 150 and tube closing module 154. Some embodiments of the tube weighing system may include load cells with strain gauges positioned to measure the weight of each filled tube 110 or a plurality of tubes 110. Other embodiments may provide a flex force sensor or a sensor array that provide for weight measurement of each of the plurality of tubes 110 or of an array of the plurality of tubes 110.

Figure 8A:
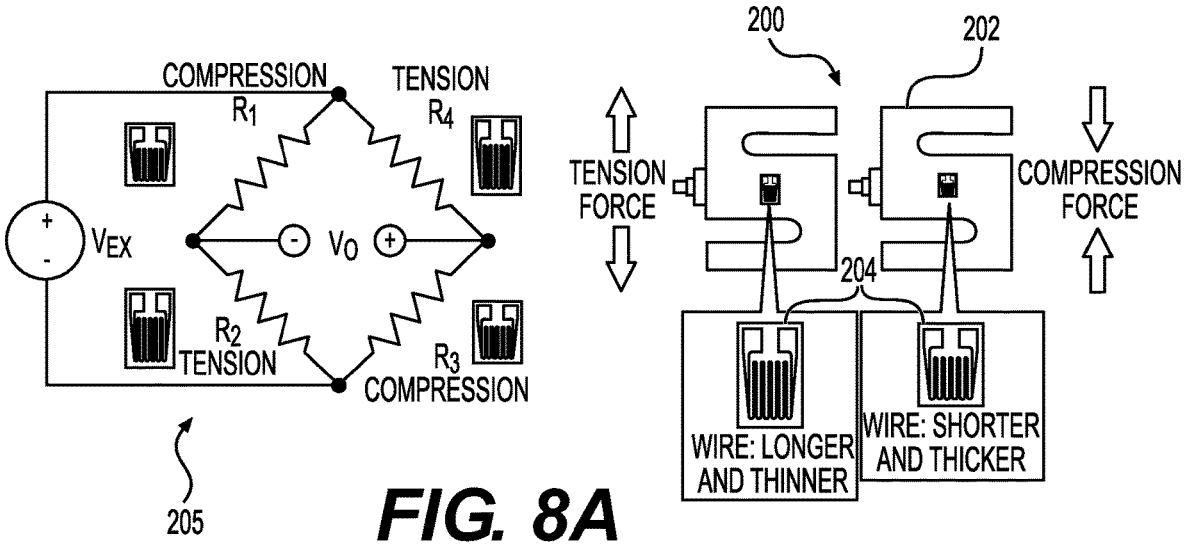
FIGS. 8A through 8U illustrate exemplary embodiments of weighing apparatuses, consistent with embodiments of the present disclosure.
Figure 8B:
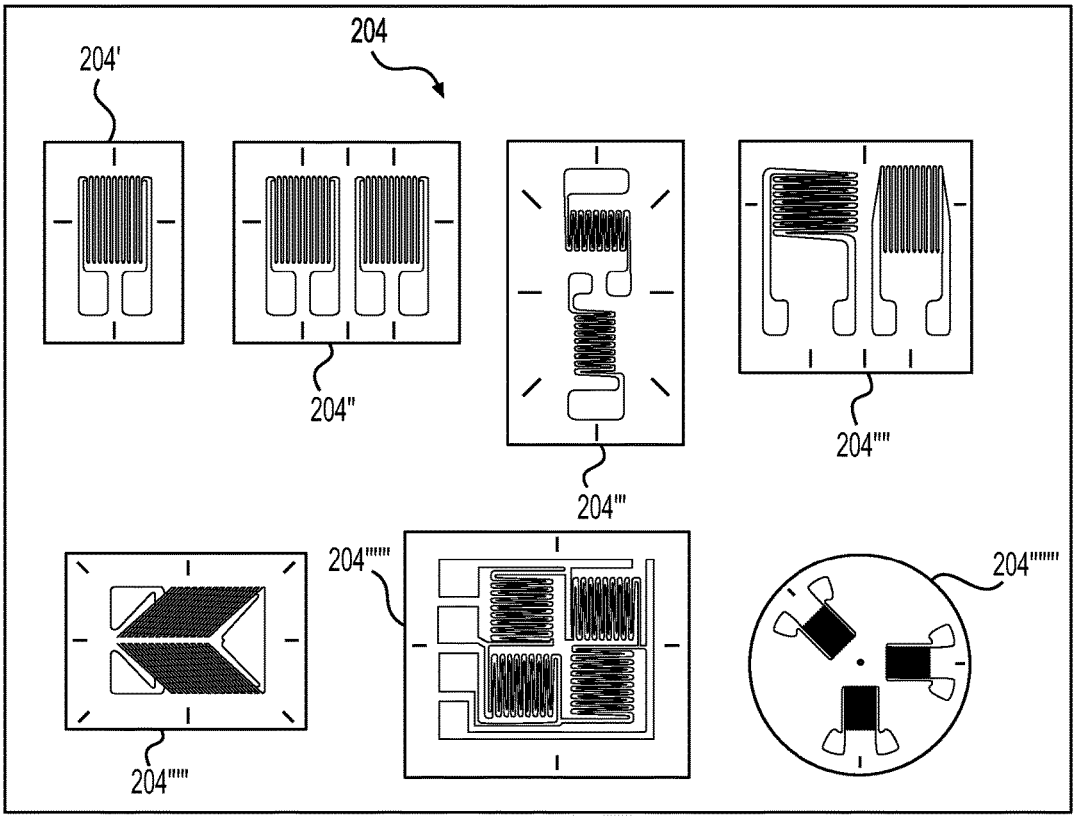
Figure 8C:
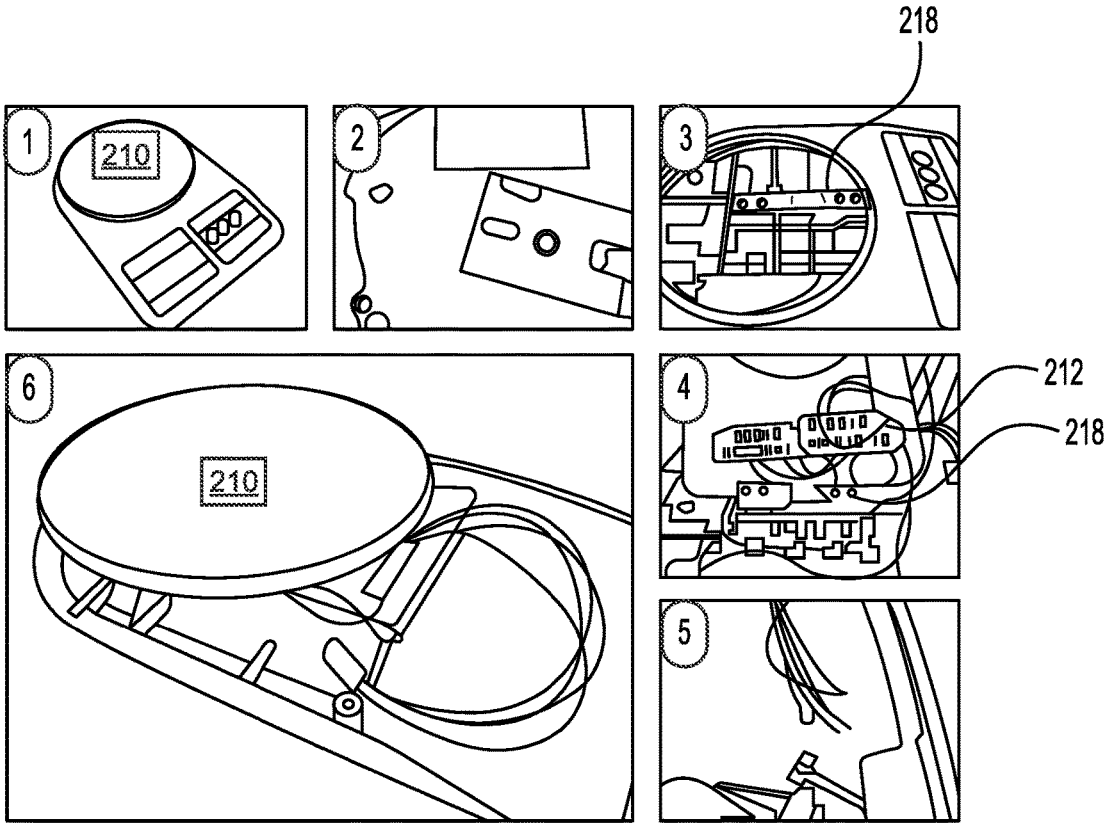
Figure 8D:
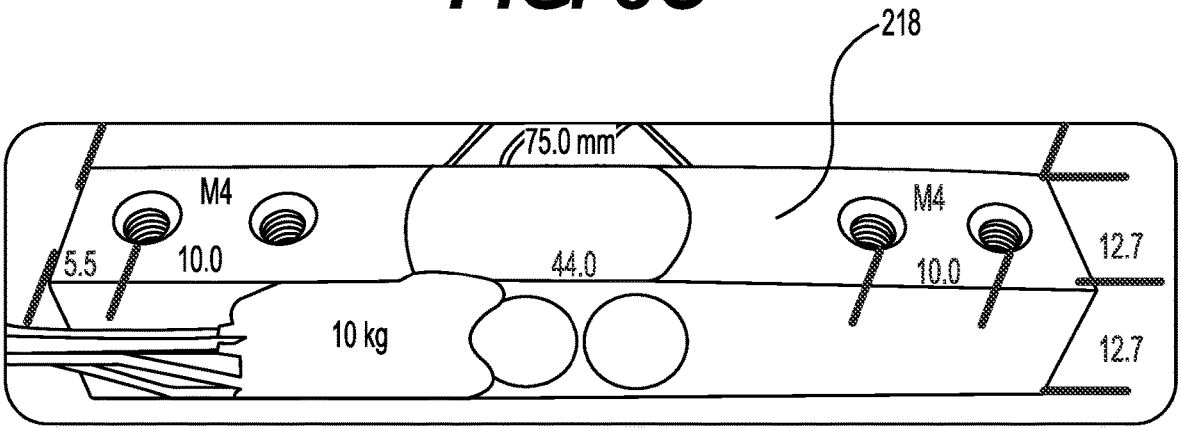
Figure 8E:
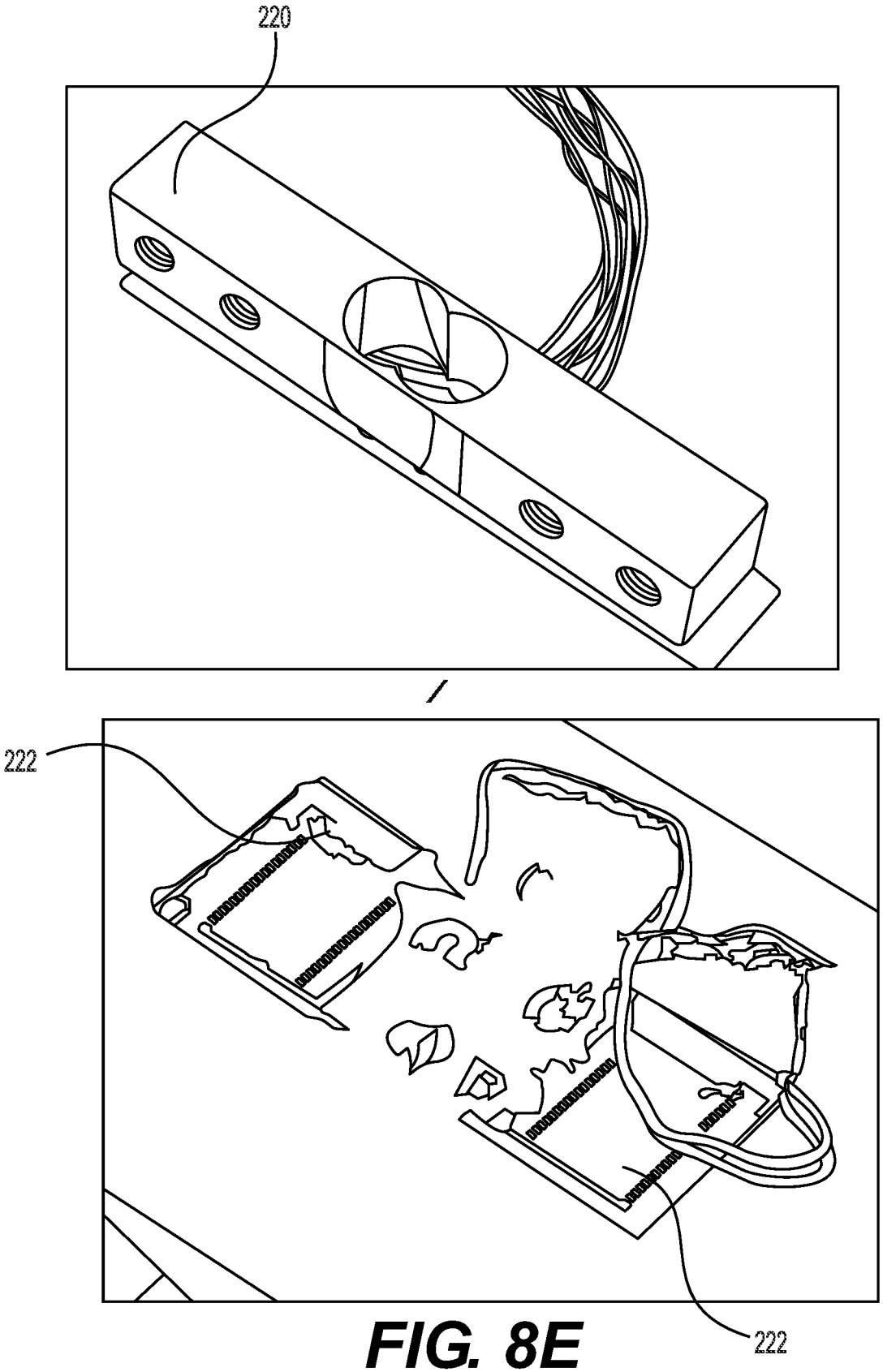
Figure 8F:
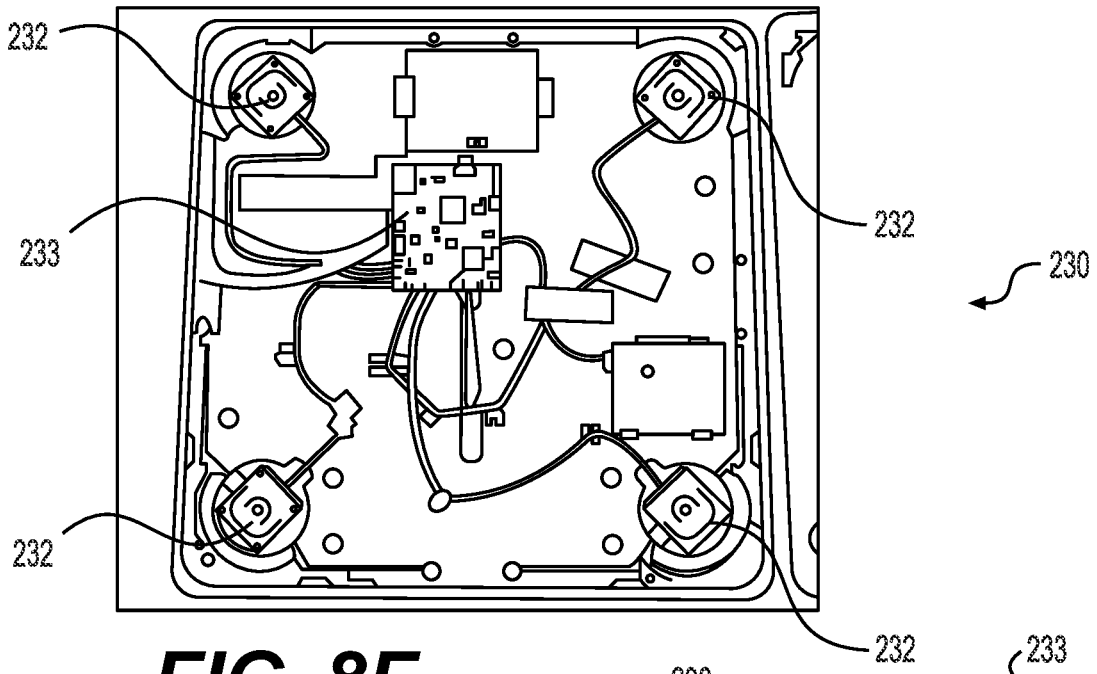
Figure 8G:
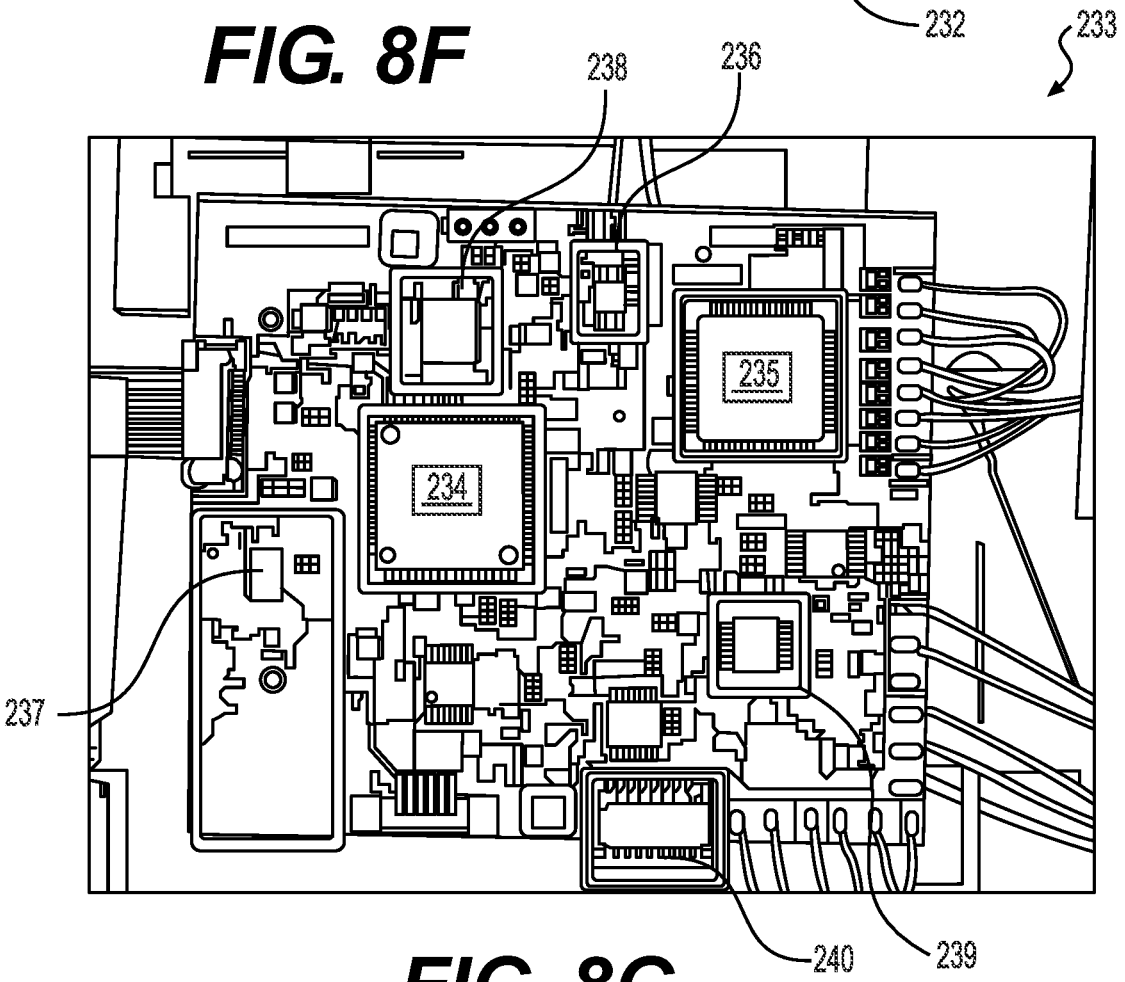
Figure 8H:
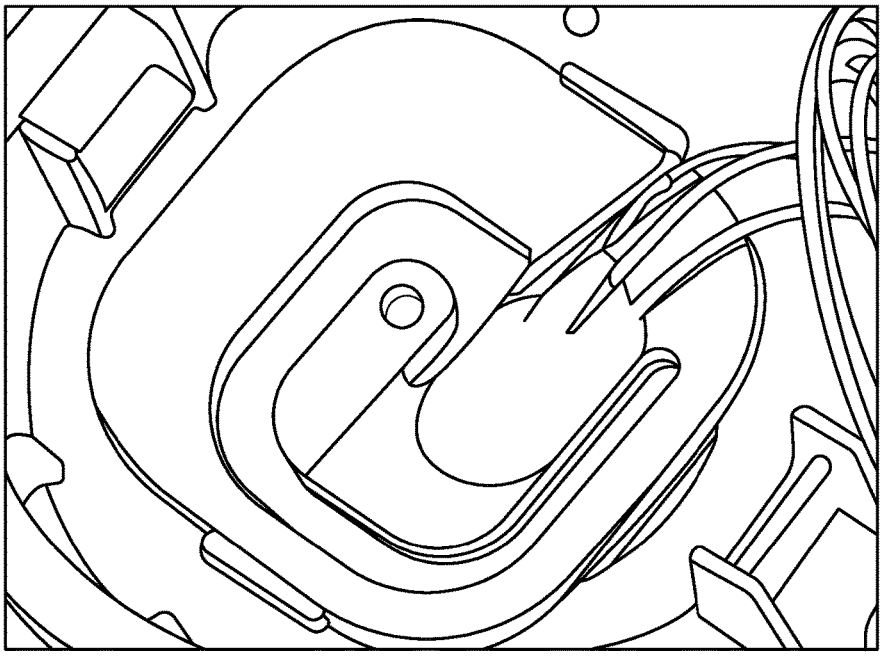
Figure 8H:
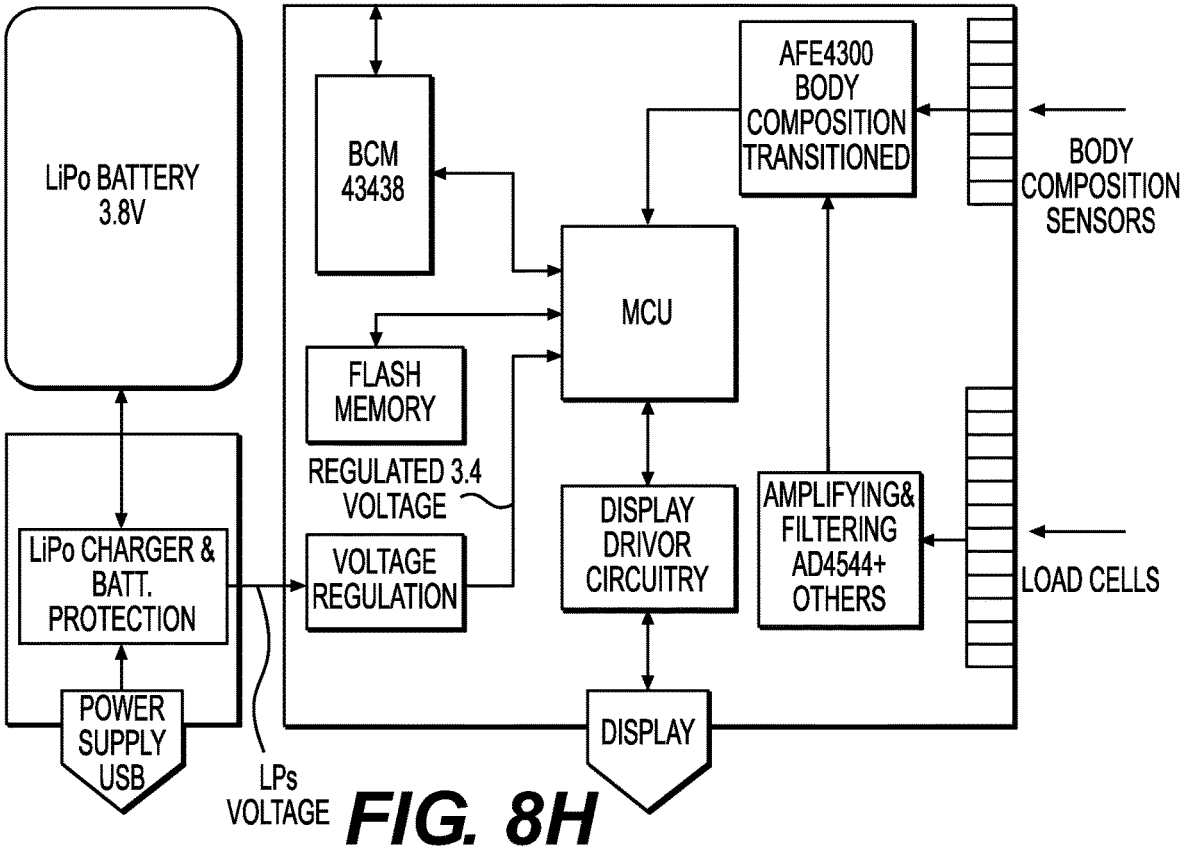
Figure 8I:
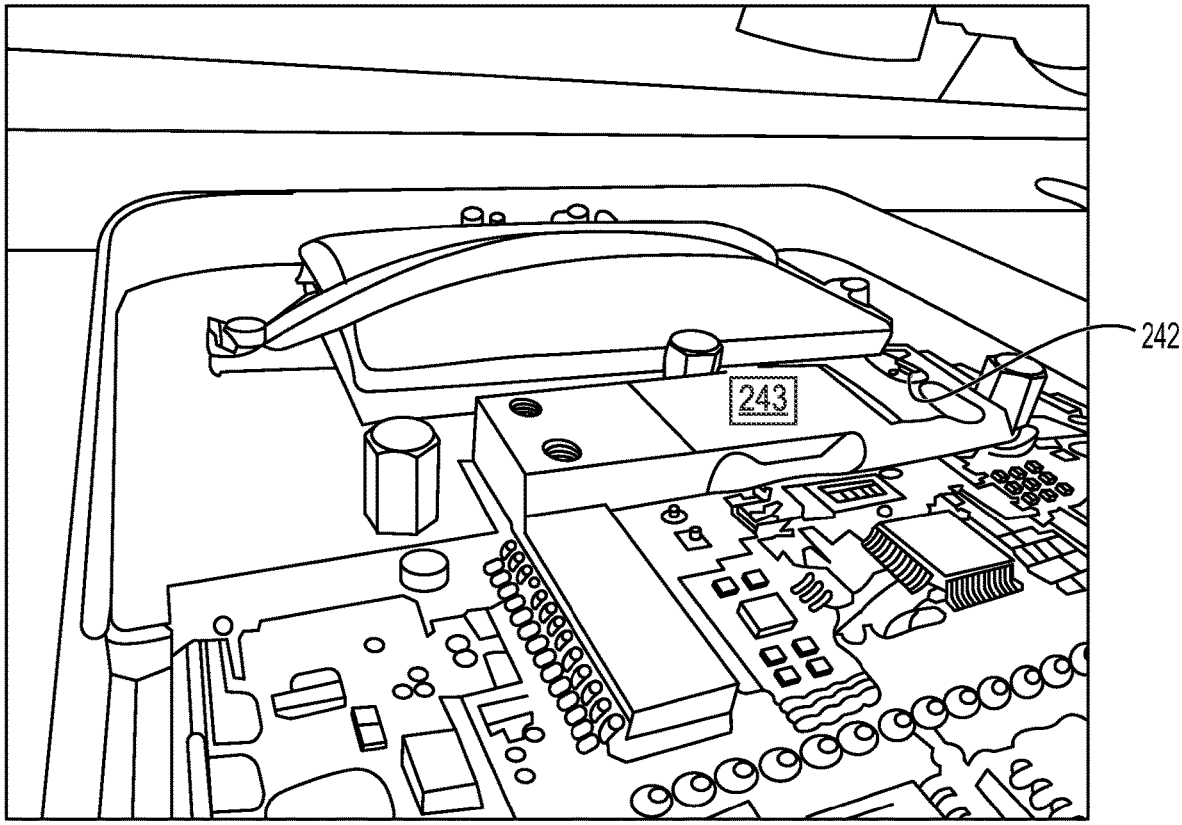
Figure 8J:
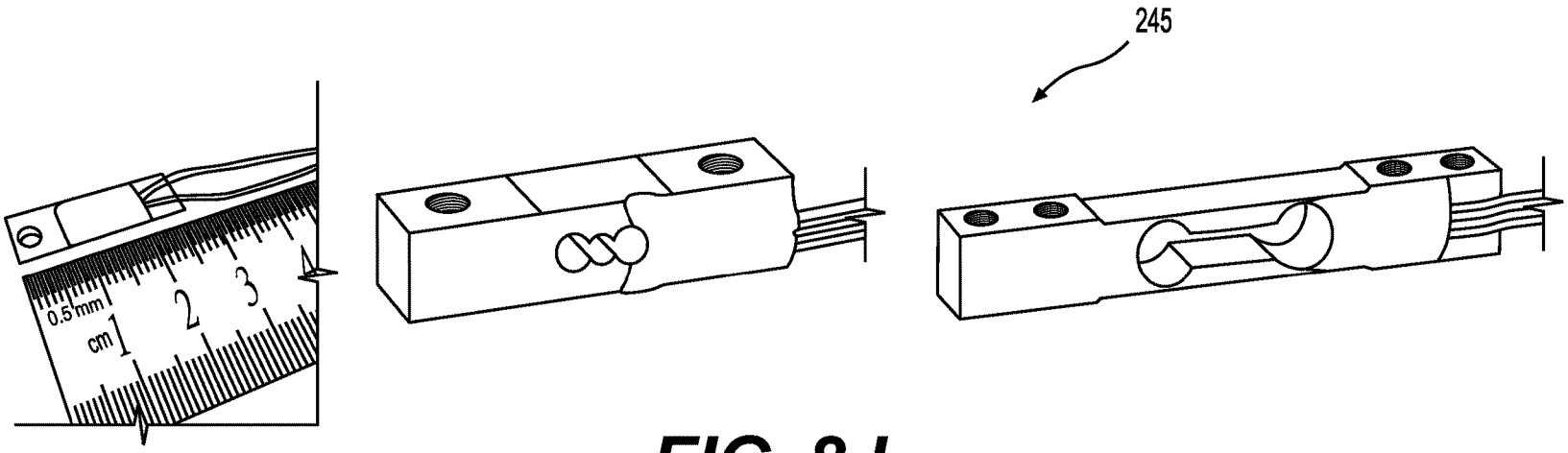
Figure 8K:
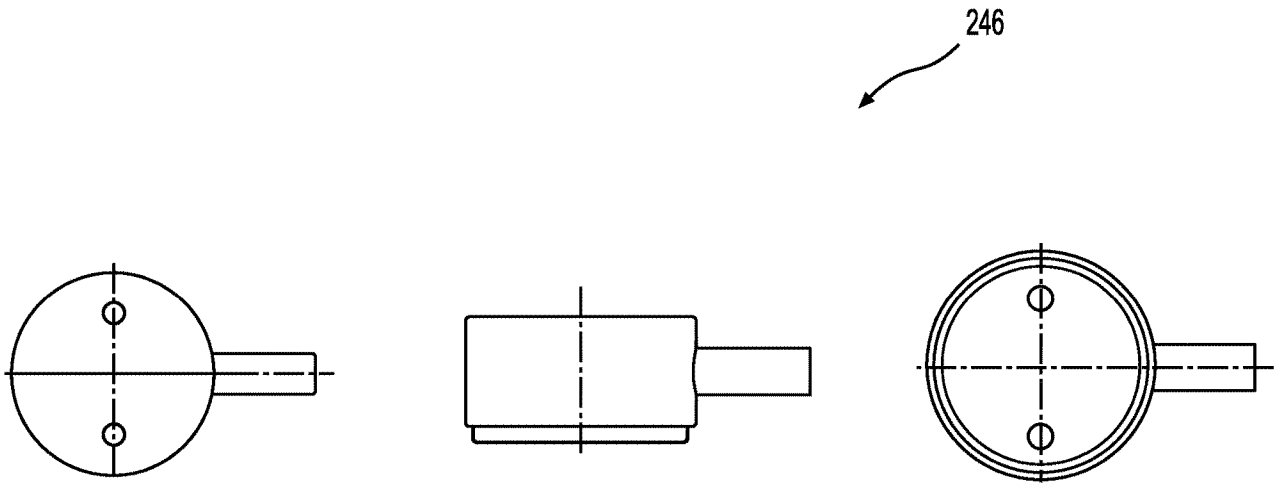
Figure 8L:
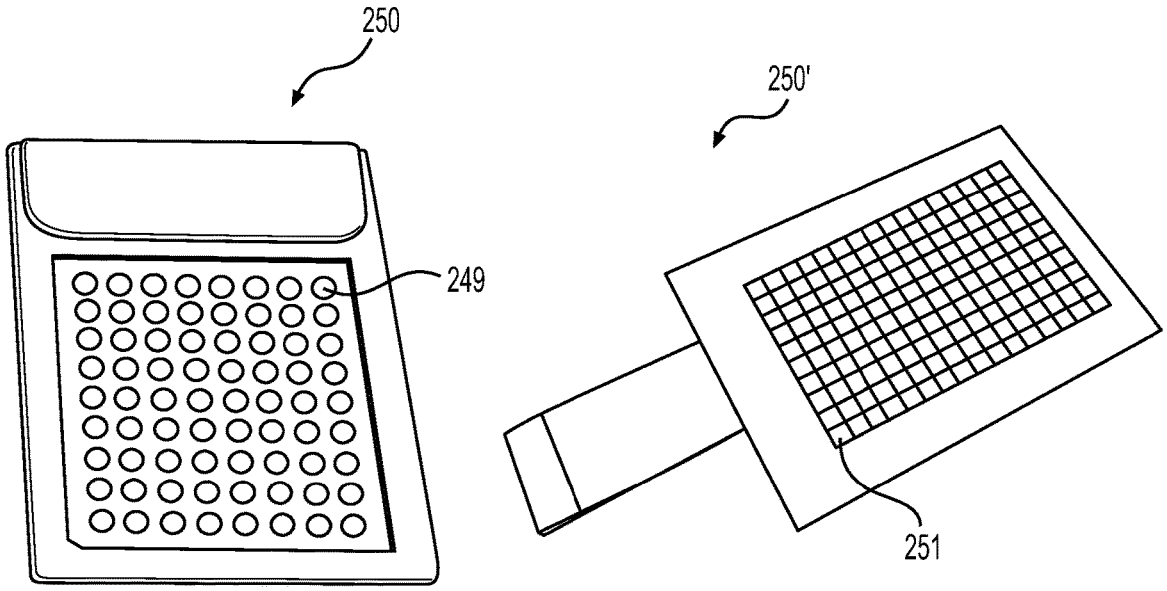
Figure 8M:
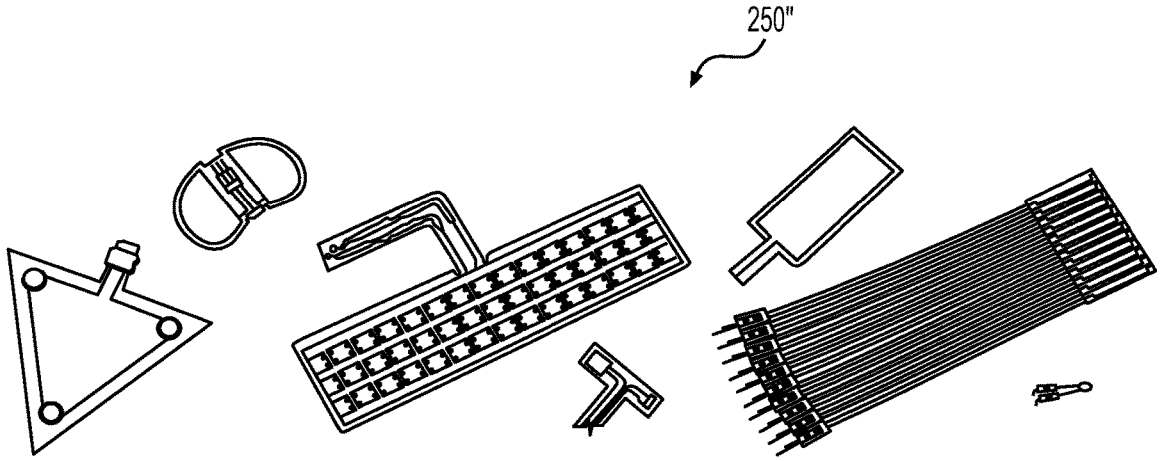
Figure 8N:
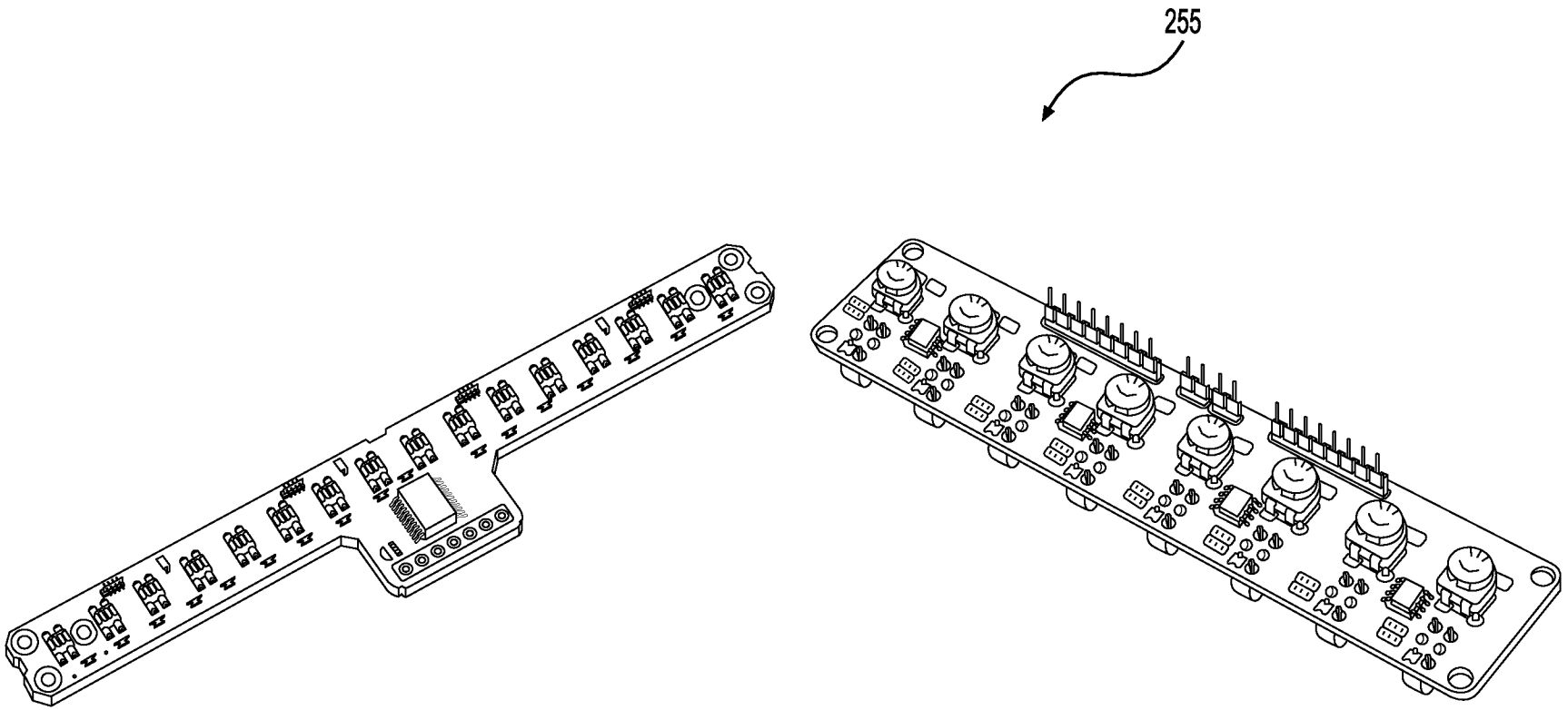
Figure 8O:
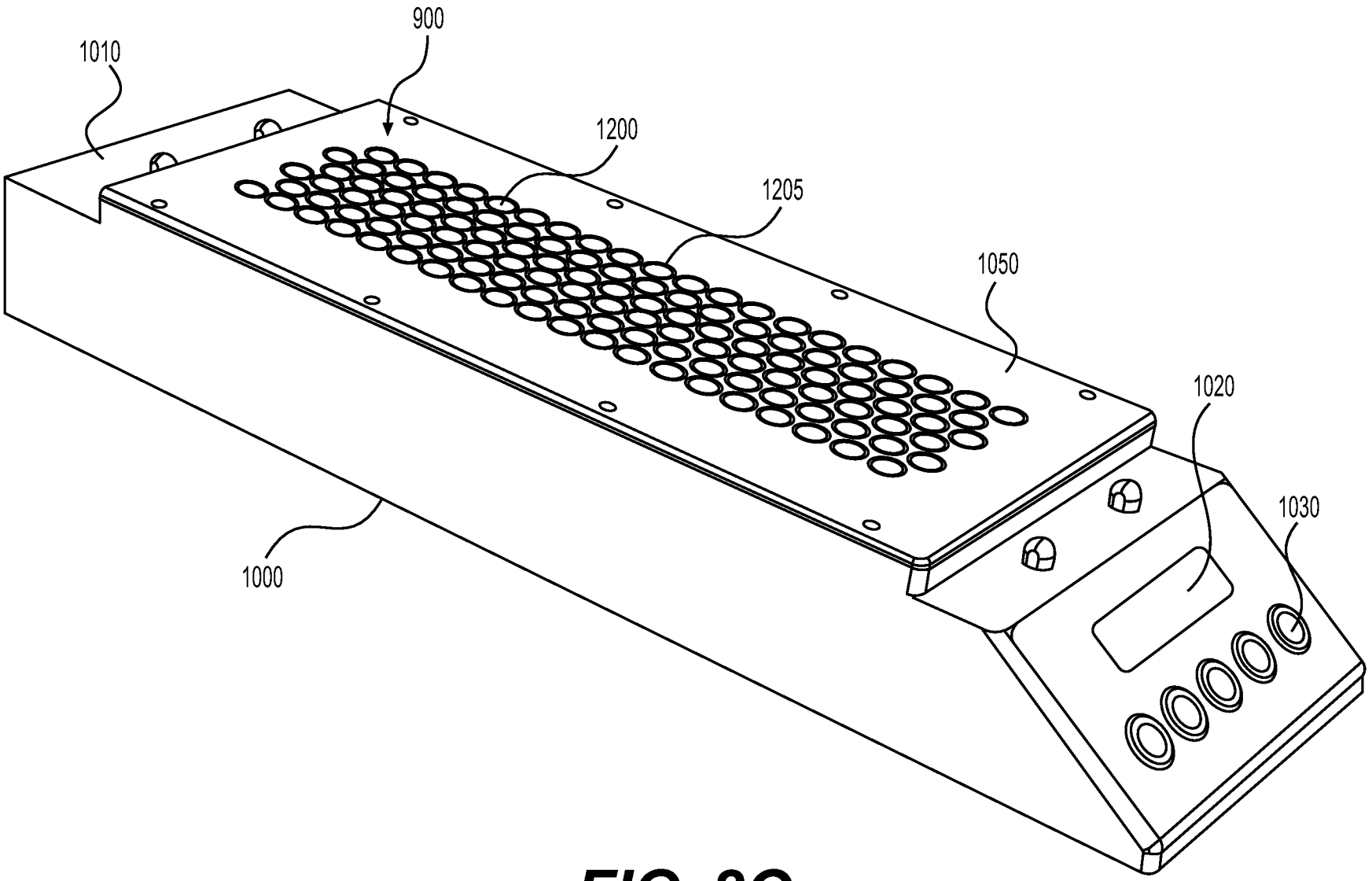
Figures 8P, 8Q, 8R:
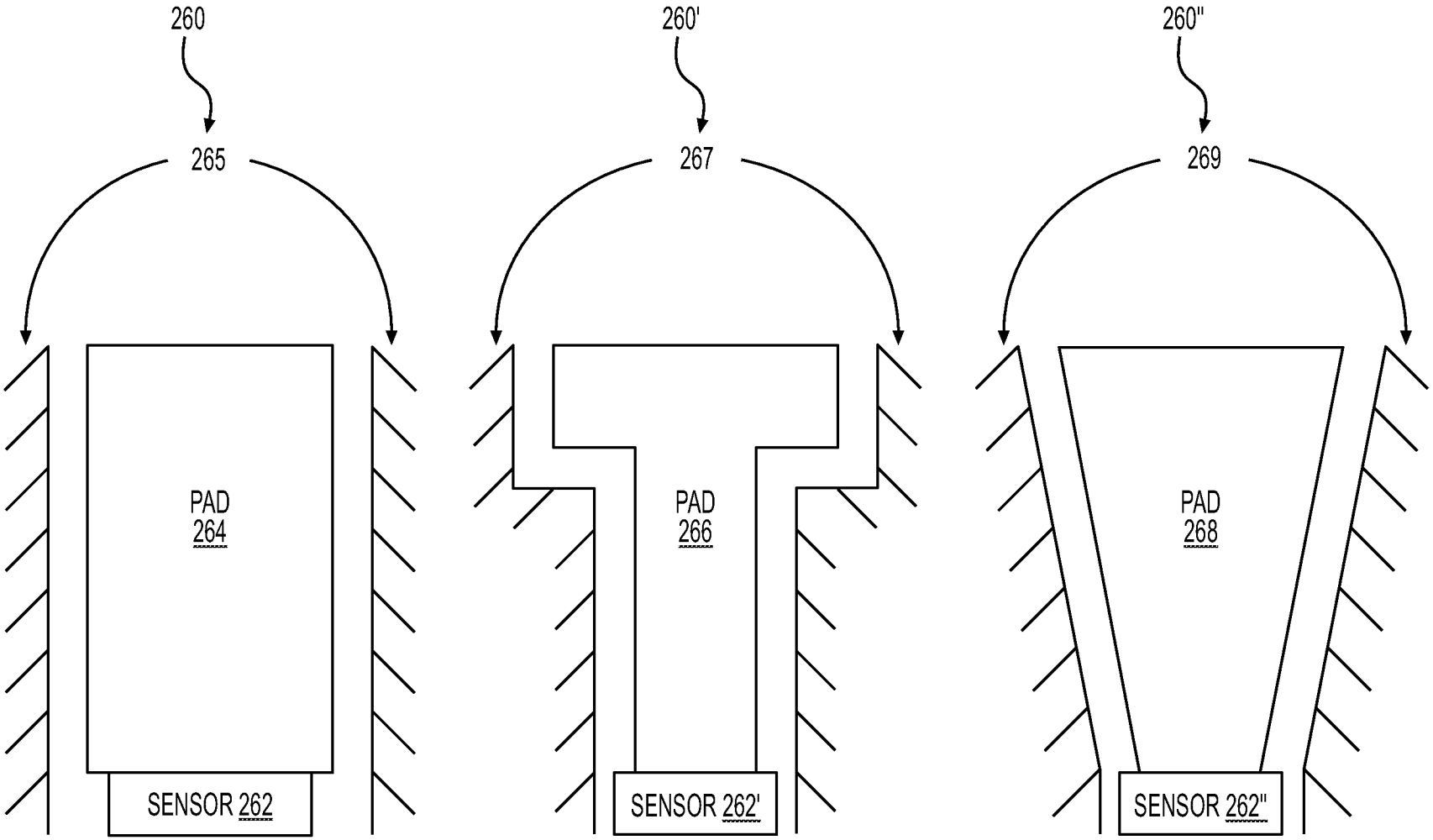
Figure 8S:
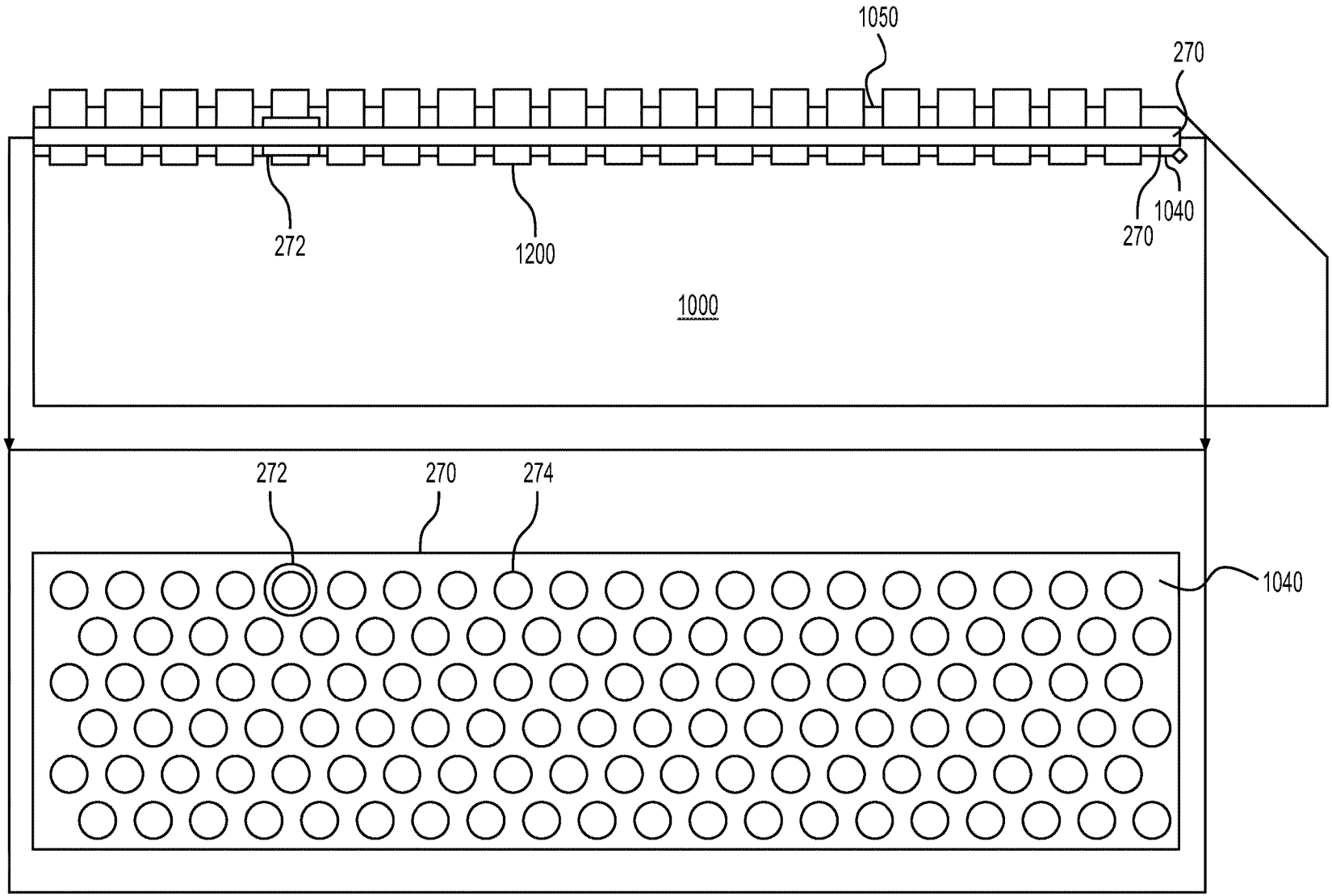
Figure 8T:
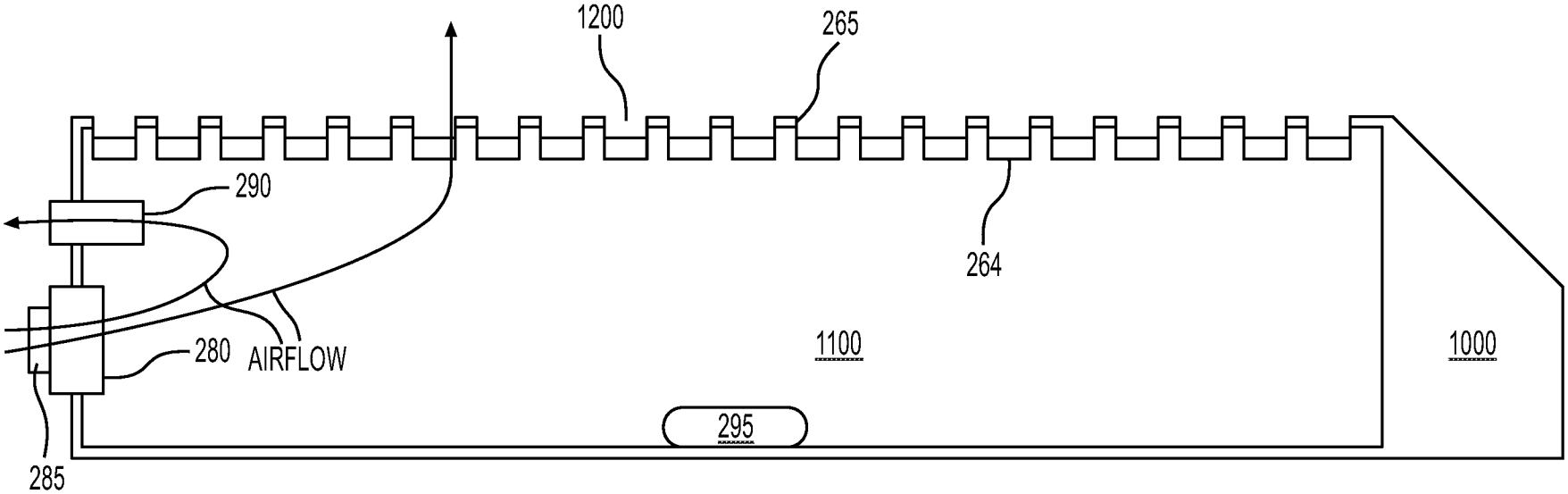
Figure 8U:
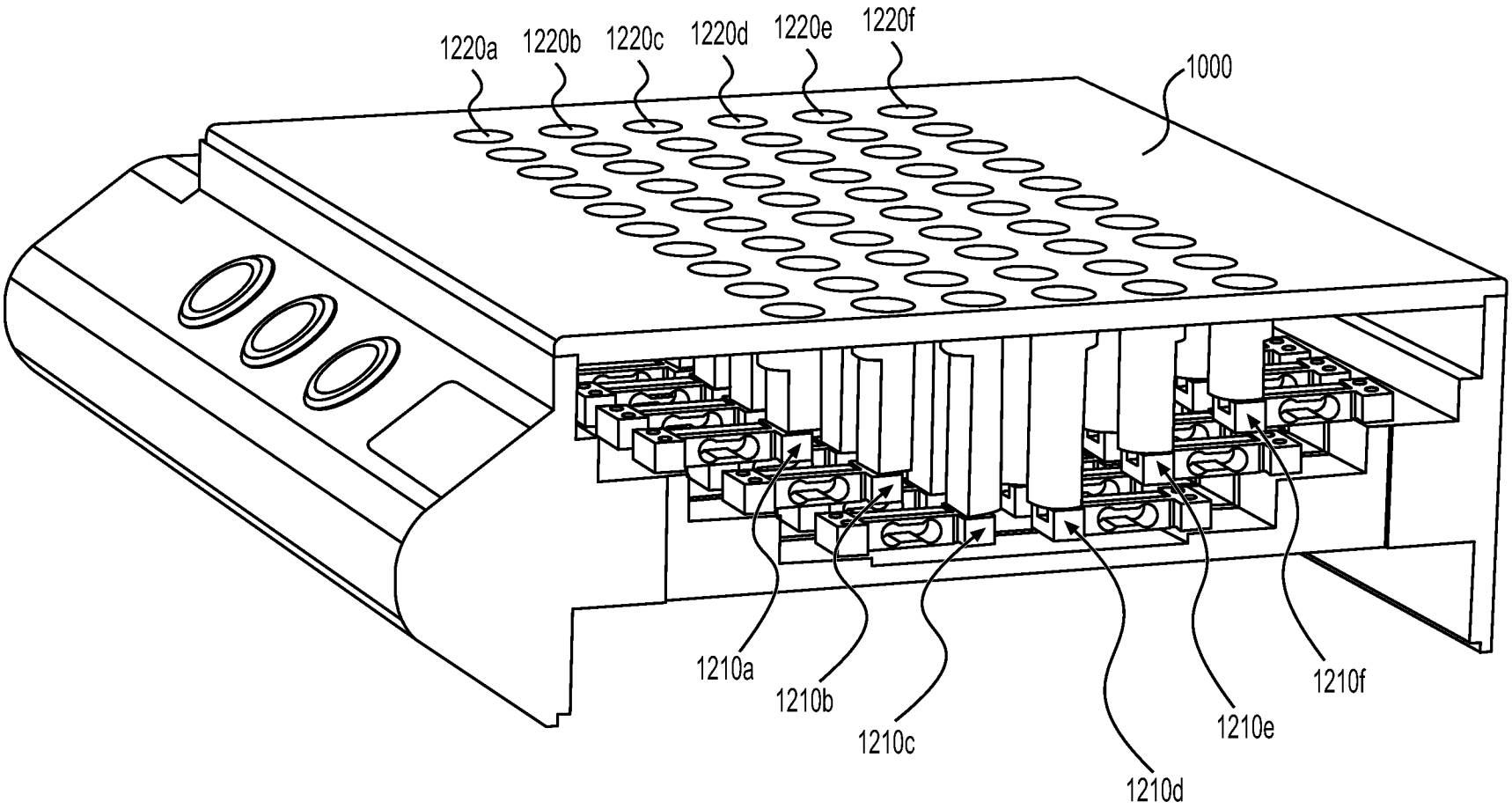

FIGS. 8A through 8U illustrate exemplary embodiments of weighing apparatuses, consistent with embodiments of the present disclosure. Each of the weighing apparatuses described herein may be implemented individually or in combination into weighing assembly 302 illustrated in FIG. 9.

Some embodiments provided in FIGS. 8A and 8B illustrate exemplary load cells 200 that may include a sensor body 202 that may be combined with one or more strain gages 204 (e.g., one or more of strain gages 204', 204", 204''', 204'''', 204''''', and 204'''''') assembled into a Winston bridge 205. The load cell 200 may utilize the changes in resistance during deformation of the sensor body 202. Depending on the type of load, the load cells 200 may operate under tension and deformation, and may output an analog signal.

FIGS. 8C and 8D illustrate a scale 210 having a board 212 with an Analog-to-Digital Converter (ADC), amplifiers, and a load sensor 218. In some embodiments, the load sensor 218 may be an ingot.

FIG. 8E illustrates a load cell 220 which may be flooded with an epoxy resin and may have strain gages 222 (which may be interchangeable with strain gages 204) connected to the load cell 220.

FIGS. 8F, 8G, and 8H illustrate a scale 230 having weight sensors 232 positioned at equal distances from each other at the corners of the scale 230. Scale 230 may include board 233. Board 233 may include processor 234, an analog front-end controller 235, battery charging chip 236, communication chip 237, flash memory 238, op amp 239, and connection port 240.

FIG. 8I illustrates a load cell 242 having a strain gage 243 attached thereto. FIG. 8J illustrates load cells 245 having different lengths. FIG. 8K illustrates load cells 246 having a cylindrical shape.

FIGS. 8L and 8M illustrate various flexible sensors 250, 250', and 250" that may include a sensor matrix. The sensor matrices may include any number of size of sensors, depending on implementation-specific considerations. For example, sensor 250 includes a matrix of circular sensors 249. For further example, sensor 250' includes a matrix of square or rectangular sensors 251. Sensor 250" may include a variety of circuitry configured to function as a flexible sensor. Flexible sensor 250, 250', and/or 250" may include a bendable sensing element located on a bendable substrate.

FIG. 8N illustrates a sensor array 255 that may include a plurality of sensors that may provide weight measurement of a plurality of tubes individually based on tubes aligned with each sensor in the array.

FIG. 8O illustrates another embodiment of the weighing apparatus. As seen in FIG. 8O, the weighing apparatus 1000 may include an array 900 of load cells 1200. In the illustrated embodiment, the array 900 includes one hundred twenty load cells 1200 arranged in six offset rows of twenty load cells 1200 each. However, the number and arrangement of load cells 1200 may vary, depending on implementation-specific considerations.

In the illustrated embodiment, each load cell 1200 includes a status indicator 1205 disposed about the load cell 1200. The status indicator 1205 may be configured to alert a user to the status of the respective load cell 1200 with which it is associated. In the illustrated embodiment, the status indicator 1205 is disposed about the periphery of the load cell 1200. However, in other embodiments, the location and configuration of the status indicator may vary. For example, the status indicator 1205 could be in the form of a light emitting diode (LED) lit ring surrounding each load cell 1200. This can be achieved, for example, by disposing a printed circuit board (PCB) with an array of LEDs (LED PCB 1040, for example, in FIG. 8S) as a backlight under a top surface 1050 of the weighing apparatus 1000. The LED PCB 1040 may include individual LEDs or groups of LEDs that are positioned to correspond to each of the load cells 1200. If the status indicator 1205 surrounding each of the load cells 1200 is made of a transparent material (e.g., plexiglass) and the top surface 1050 is made of an opaque material (e.g., metal), light emitted from a particular LED on the LED PCB 1040 may be seen to surround the corresponding load cell 1200 in a lit ring that comprises the status indicator 1205. The LEDs of the lit ring 1205 may be capable of emitting light in multiple colors which may indicate different statuses. For example, green light could indicate that a tube is within weight tolerances, blue light could indicate that a tube is too light and may be filled further, red light could indicate that a tube is too heavy and should be discarded, and/or white could indicate that weight calibration is needed.

The weighing apparatus 1000 also includes a docking interface 1010 for receiving devices carrying tubes to be weighted such as tube sealing system 152 described above and/or weighing carriages 620 described below. When a receiving device is docked in docking interface 1010, the carried tubes may rest upon individual load cells 1200 to be weighed. Depending on the weights measured by the individual load cells, the status indicator 1205 may emit a relevant color indicative of tube status, such as described above. If using a weighing carriage 620 (e.g., as shown in FIGS. 10F through 10K), it may be desirable to transmit colored light from individual lit status indicators 1205 to the surface of the weighing carriage 620. This can be done, for example, by lining the tube holder openings 622 with a transparent material (e.g., plexiglass) that will draw the colored light to surround individual tube openings 622 and can be seen when looking down on the weighing carriage 620. In some arrangements, the transparent material surrounding the tube holder openings 622 are wrapped in a dark or foil covering to prevent light from a particular LED ring forming status indicator 1205 from bleeding into neighboring tube holder openings 622.

The weighing apparatus 1000 also includes a display 1020 and buttons 1030 for controlling and receiving feedback regarding operation of the weighing apparatus 1000. Control could include, calibration, setting tolerances, programing LED colors, changing units of measurement, cycling between preset configurations, adjusting configurations, etc. The display 1020 may also be a touchscreen which may negate the need for buttons 1030 in some embodiments.

FIGS. 8P, 8Q, and 8R illustrate embodiments of load cells 260, 260', and 260" that may be used alone or in combination to weigh one or more tubes in one or more of the weighing apparatuses disclosed herein. Load cells 260, 260', and 260" may be defined by load cell walls 265, 267, 269, respectively. Load cells 260, 260', and 260" may have weight sensors 262, 262', and 262", respectively. Load cells 260, 260', and 260" may have weighing pads 264, 266, 268 respectively.

To reduce or prevent the likelihood of inaccurate weight readings, disclosed embodiments include one or more features that reduce or prevent the likelihood of dust interfering with the weight sensing of the weighing apparatus. In order to reduce or prevent dust (e.g., from spilled herbal mixture material) or other raw material from accumulating between each respective weight sensor (e.g., 262) and its respective weighing pad (e.g., 264), which could lead to faulty weight readings, alternatively shaped pads, such as weight pads 266, 268 may be used to increase spill protection. As seen in FIG. 8P, weight pad 264 is cylinder shaped and is disposed within cylindrically shaped load cell wall 265, consistent with one embodiment. The verticality of pad 264 and wall 265 may allow for dust to easily pass and potentially end up between the pad 264 and sensor 262 in one embodiment. As seen in FIGS. 8Q and 8R, alternative shapes of the pad 266, 268 and/or walls 267, 269 may make it more likely that falling dust would wind up adhering to the walls 267, 269 instead of ending up between the pads 266, 268 and sensors 262, 262', and 262". Other suitable shapes may also be used, depending on implementation specific considerations, to impede dust from becoming disposed between the respective pads and sensors shown in FIGS. 8P-R.

FIG. 8S illustrates an embodiment of the weighing apparatus 1000 with a dust barrier plate 270. The bottom portion of FIG. 8S is a schematic cross section of the plate 270. In some embodiments, the dust barrier plate 270 may be disposed between the top surface 1050 and the LED PCB 1040 at a level above where pads 1220 contact sensors 1210. In the illustrated embodiment, the dust barrier plate 270 has a plurality of openings 274, each surrounded by a seal 272 (e.g., rubber) shaped to accommodate a pad 1220 of a load cell 1200. When dust falls in the gaps surrounding the pads 1220 (for example, the gap between the wall 265 and pad 264 in FIG. 8P), the seal 272 acts as a barrier to reduce or prevent the likelihood that dust or debris will reach sensors 1210.

FIG. 8T illustrates an embodiment of the weighing apparatus 1000 that is configured to blow away dust and/or debris that may fall in the gaps surrounding the pads 1220 (for example, the gap between the wall 265 and pad 264 in FIG. 8P). Apparatus 1000 includes an inlet fan 280, a inlet air filter 285, an outlet valve 290, and a pressure sensor 295. In some embodiments, pressure sensor 295 may be configured to measure a pressure inside chamber 1100. In some embodiments, if pressure sensor 295 measures a pressure inside chamber 1100 that less than or equal to an atmospheric pressure outside of the apparatus 1000, then inlet fan 280 may begin to draw air into the chamber 1100. Fan filter 285 may filter the air entering chamber 1100. Fan filter 285 may reduce or eliminate the likelihood that dust or other particles are drawn into the chamber 1100. As the pressure inside the chamber 1100 rises above the atmospheric pressure outside of the apparatus 1000, air may exit the chamber 1100 through outlet valve 290 and/or the gaps surrounding the pads 1220. In this way, dust and/or debris that has accumulated within the apparatus 1000 may be blown out of the apparatus 1000. This may reduce or prevent the likelihood of dust accumulating between the sensors 1210 and the pads 1220.

FIG. 8U illustrates weighing apparatus having a stepwise sensor 1210 arrangement in the weighing apparatus 1000. It is desirable to maximize the number of pads 1220 on the weighing apparatus 1000 so that a large number of tubes may be weighed at one time. Due to the size of the sensors 1210, in some arrangements, the number of corresponding pads 1220 that will fit in the weighing apparatus 1000 is reduced if the sensors 1210 were to be oriented next to each other on the same horizontal planar surface within the chamber 1100. To achieve a higher total load cell 1200 count and density, a stepwise sensor 1210 configuration may be implemented in some embodiments. As seen in FIG. 8U, the sensors 1210*a* of a first row of load cells 1200 are attached to the apparatus 1000 housing at a first higher level, and the sensors 1210*b* of a second row of load cells 1200 are attached to the apparatus 1000 housing at a second lower level. Accordingly, the sensors 1210*a* are able to overlap horizontally with sensors 1210*b* (and therefore take up less space horizontally) by being arranged at different vertical levels. Sensors 1210*c-f* are similarly arranged in this stepwise manner to achieve an efficient use of space. To accommodate sensors 1210*a-f* at different vertical levels, pads 1220*a-f* of different heights may be utilized in some embodiments so that the tube contact surface of the pads 1220 are all at the same or approximately the same level.

Each embodiment shown in FIGS. 8A to 8U may be used as a weighing apparatus to weigh one or more tubes (e.g. tubes 110) when the tubes are positioned in recesses 322 and/or openings 164. Additionally, or alternatively, the embodiments shown in FIGS. 8A to 8U may be used to measure individual tubes 110 or a plurality of tubes 110 at a time. For example, any of the embodiments shown in FIGS. 8A to 8U may be aligned with each recess 322 and/or opening 164 to allow for individual weighing of each tube 110 loaded into each respective recess 322 and/or opening 164.

The embodiments shown in FIGS. 8A to 8U may also provide for weighing of a plurality of tubes 110 at the same time. For example, the embodiments shown in FIGS. 8A to 8U may be positioned below a row of recesses 322 and/or a row of openings 164 and may weigh an entire row of tubes 110. In other embodiments, the embodiments shown in FIGS. 8A to 8U may be positioned below a section of recesses 322 and/or a row of openings 164 and may weigh an entire section of tubes 110.

Figure 9:
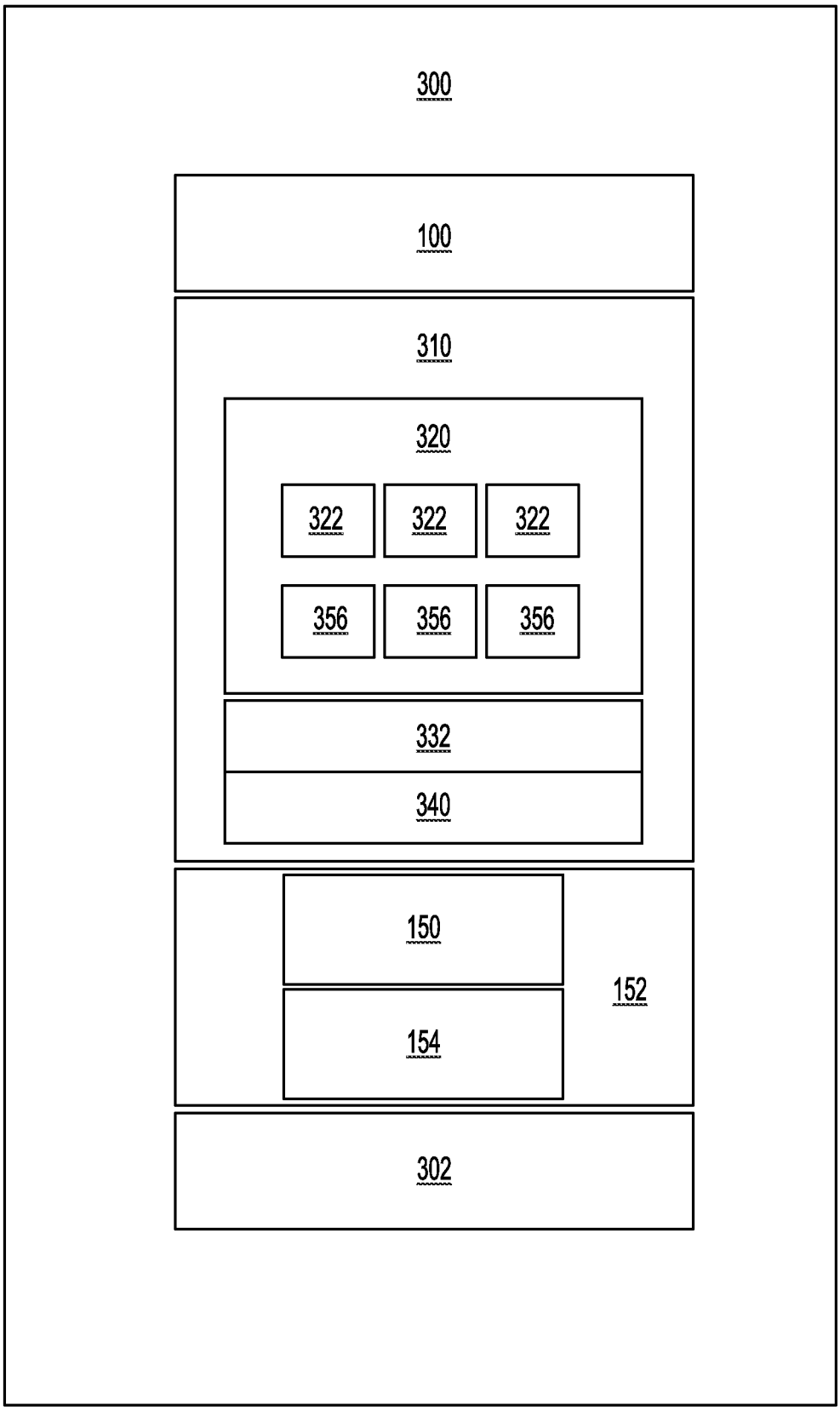
FIG. 9 is a schematic of a tube processing system, consistent with embodiments of the present disclosure.

FIG. 9 illustrates an exemplary tube processing system 300 that may include a tube loading apparatus (e.g. tube loading apparatus 100 described above), a tube sealing apparatus (e.g. tube sealing system 152), the tube sealing apparatus 152 may include a tube holder module (e.g. tube holder module 150 and a tube closing module (e.g. tube closing module 154). Tube processing system 300 may also include a weighing apparatus (e.g. weighing apparatus 302).

Tube processing system 300 may also include an exemplary a tube filling apparatus 310. Tube filling apparatus 310 includes a base 340 and a filling assembly 320, mountable on the base 340. Tube filling assembly 320 has a plurality of tube receiving recesses 322 wherein tubes may be received. Tube filling apparatus 310 may further include a vibration plate 332 that may be positioned between the base 340 and the filling assembly 320. Tubes may rest on vibration plate 332 when positioned in recesses 322. In some embodiments, tube filling apparatus 310 may also include transducer such as a speaker that may be connected to vibration plate 332 that may vibrate vibration plate 332. Vibration plate 332 may be capable of moving independently from the filling assembly 320. "Move independently" may refer to the vibration plate 332 moving (i.e. vibrating) while the filling assembly 320 remains stationary (i.e. does not vibrate).

Pillars may connect the filling assembly 320 to the base 340, and may extend through holes in the vibration plate 332, thereby positioning the filling assembly 320 on the base. Although the vibration plate 332 may be secured in a generally horizontal plane by the pillars it is allowed to move freely in a generally vertical direction. Accordingly, the vibration plate 332 is capable of moving independently from the filling assembly 320 and base 340.

In some embodiments, tube filling apparatus 310 may include fans 356 mounted in a removable fan tray, which is connected to the base 340.

FIGS. 10A through 10K illustrate exemplary embodiments of the tube processing system in use, consistent with embodiments of the present disclosure.

Figure 10A:
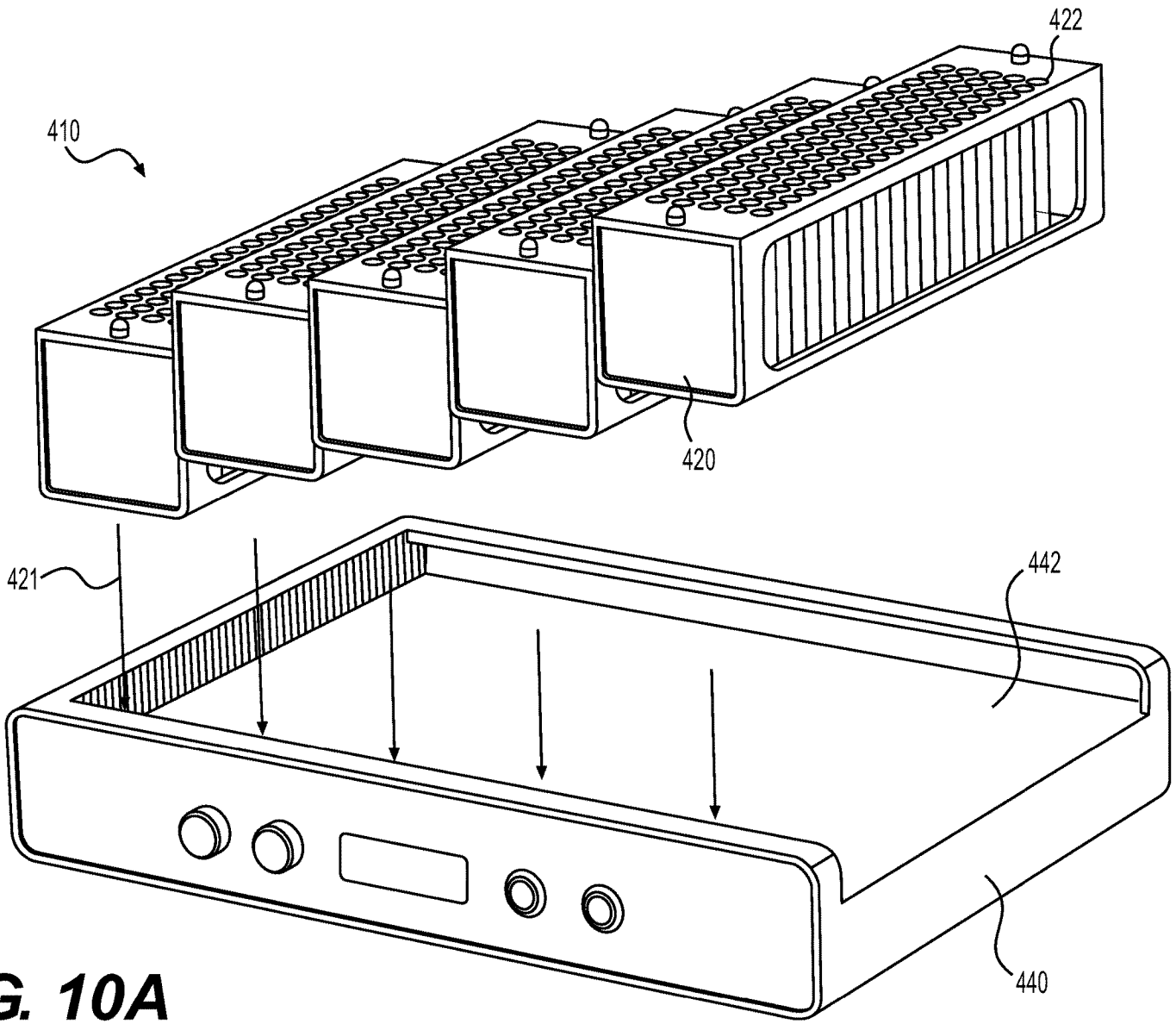
FIGS. 10A through 10K illustrate exemplary embodiments of tube loading systems, consistent with embodiments of the present disclosure.
Figure 10B:
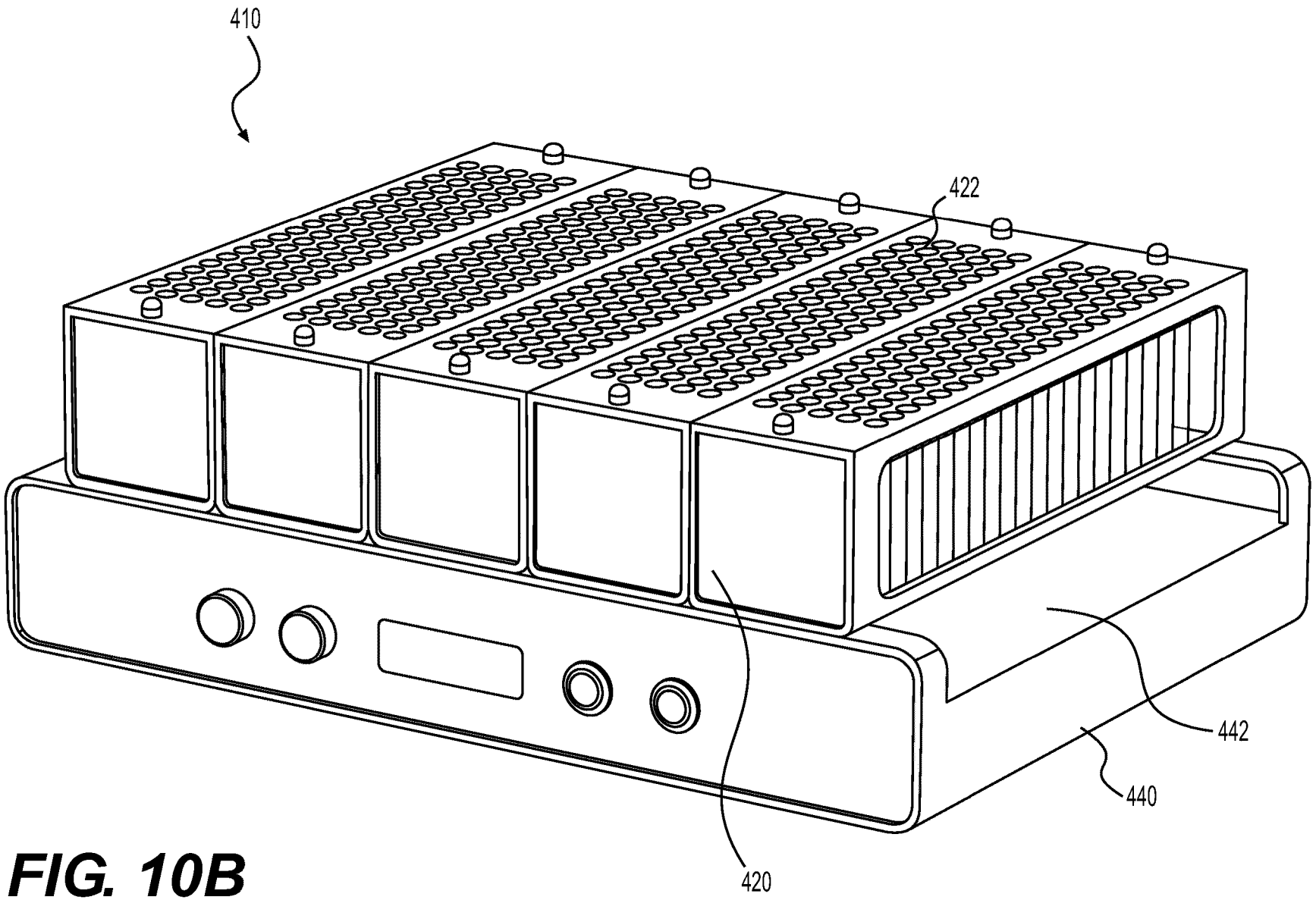

FIGS. 10A and 10B illustrate an assembly of the tube filling apparatus 410, consistent with one embodiment of the disclosure. In the illustrated embodiment, the tube filling apparatus includes at least one filling assembly 420 and a base 440. In the illustrated embodiment, the base 440 includes a vibration plate 442 that is configured to vibrate (e.g., laterally, vertically, or both) with respect to the rest of the base 440. As seen in the embodiment of FIG. 10A, a plurality of filling assemblies 420 are lowered onto the base 440, as illustrated by arrows 421 to reach the final position seen in FIG. 10B. In this embodiment, each of the filling assemblies 420 are configured to receive one hundred tubes in openings 422. In other embodiments, more or less filling assemblies 420 will fit onto the base 440 than are shown in FIGS. 10A and 10B. Additionally, in other embodiments, each filling assembly 420 has more or less openings 422 capable of receiving tubes than are shown in FIGS. 10A and 10B.

Figure 10C:
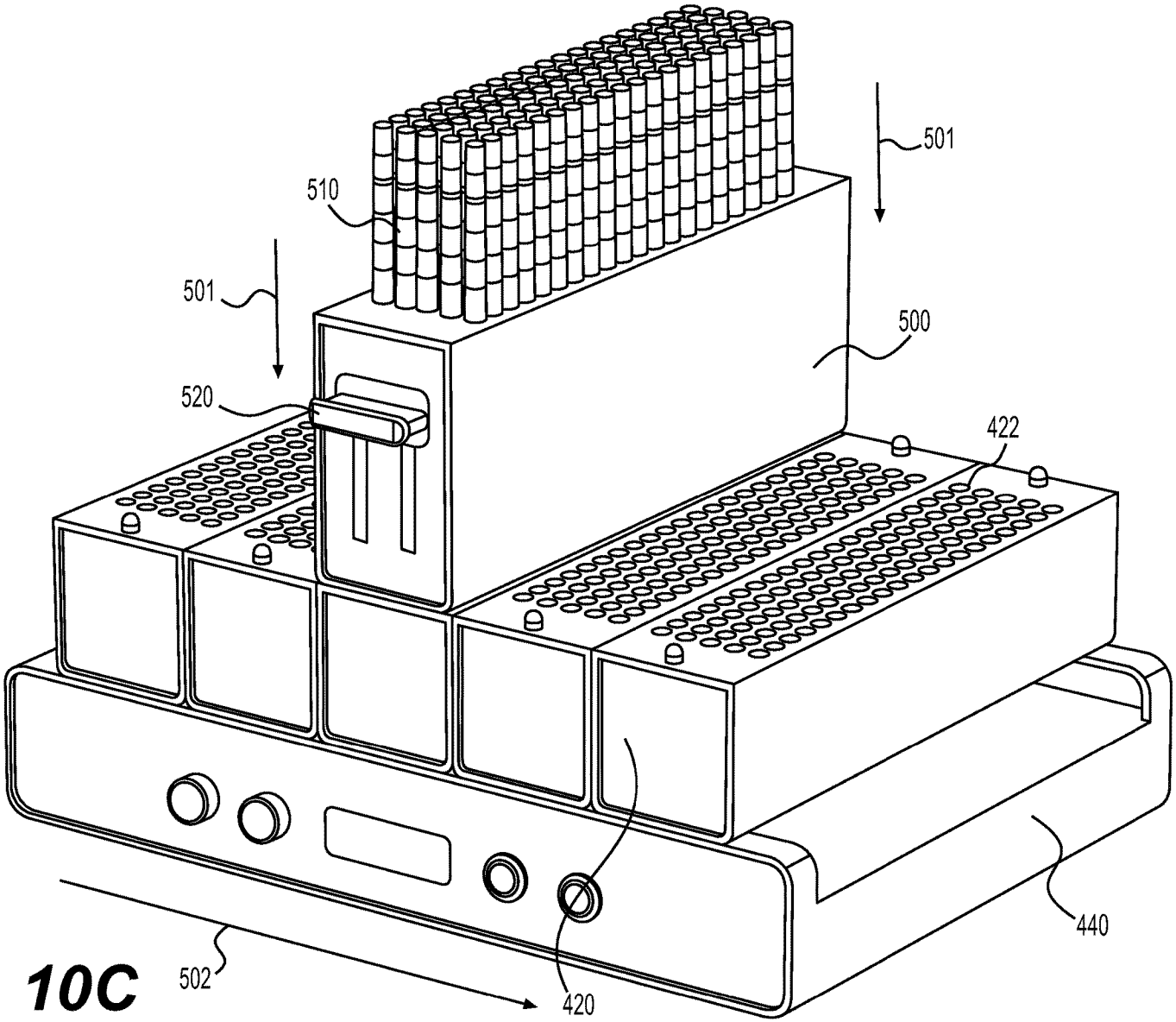

FIG. 10C illustrates an embodiment of a tube loading apparatus 500 for depositing empty tubes 510 into the openings 422 of the filling assemblies 420. In the illustrated embodiment, the tube loading apparatus 500 is filled with stacks of tubes 510 arranged in an array that corresponds to the number of openings 422 in each filling assembly 420 (in the example illustrated embodiment, a five by twenty array for a total of one hundred stacks of tubes). The tube loading apparatus 500 may include a lever 520. When the lever 520 is depressed, a single tube 510 may be released in the direction 501 from each of the stacks of tubes 510 in the array. However, in other embodiment, the lever may be configured to release a different number of tubes. Instead of lever 520, the tube loading apparatus 500 could incorporate features such as the upper slider 118, the lower slider 120, the guide tubes 112, and the actuator 122 of the tube loading apparatus 100 that is described above and depicted in FIGS. 1 through 3B. As discussed below, after the tube loading apparatus 500 deposits the empty tubes 510 into a first filling apparatus 420, the tube loading apparatus moves in direction 502 to deposit tubes 510 into the next filling apparatus 420.

In some embodiments, the tube loading apparatus 500 is initially aligned with the first filling assembly 420. During operation in some embodiments, the lever 520 may be depressed to release one or more tubes 510 into one or more of the openings 422 of the tube loading apparatus 500. Next, in one example operation, the tube loading apparatus 500 may be moved in the direction 502 to be aligned with the second filling assembly 420. The lever 520 may be depressed to release one or more additional tubes 510 into the openings 422 of the second loading apparatus. This may be repeated until all five filling assemblies 420 are fully loaded with empty tubes 510.

Figure 10D:
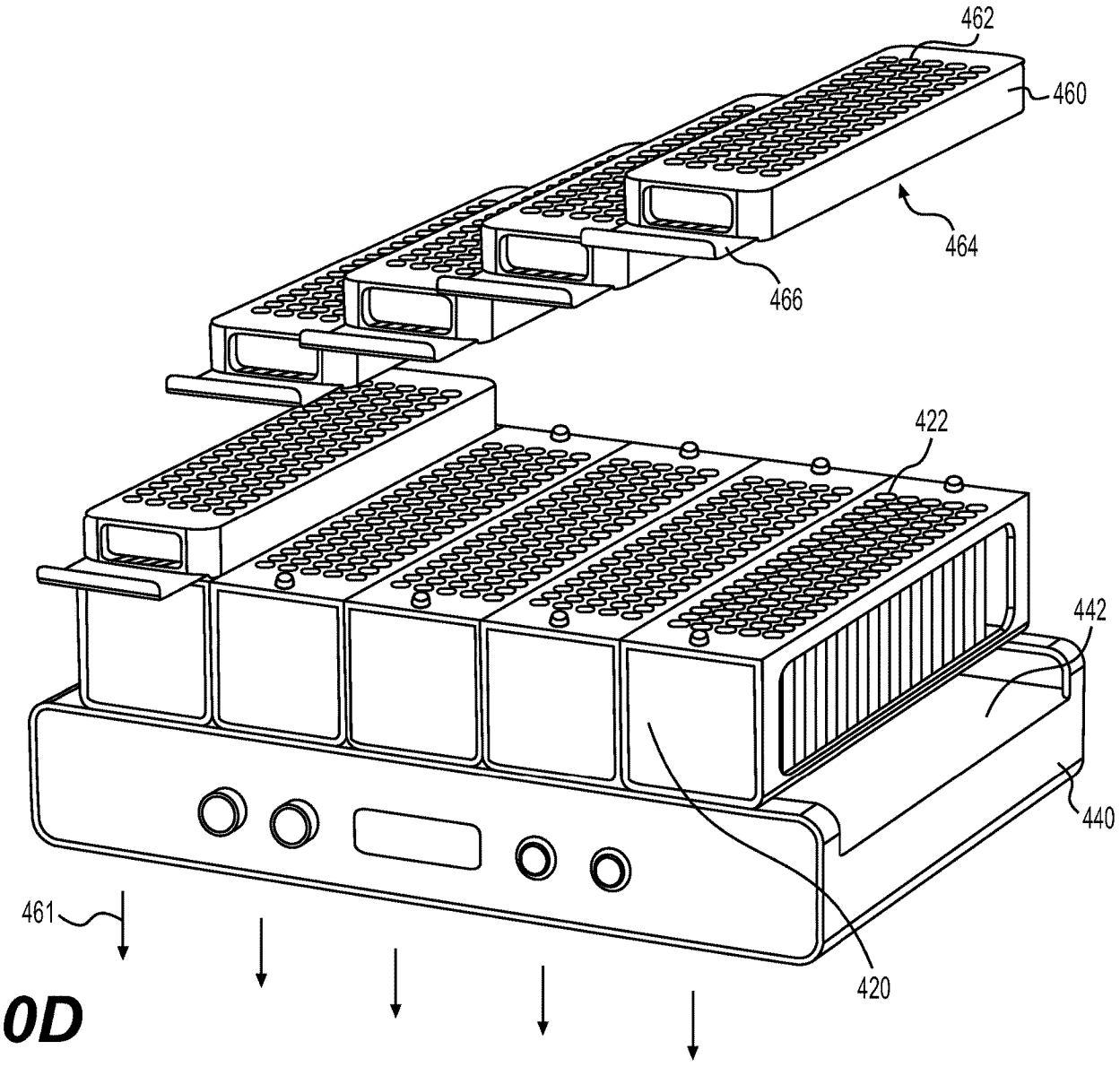
Figure 10E:
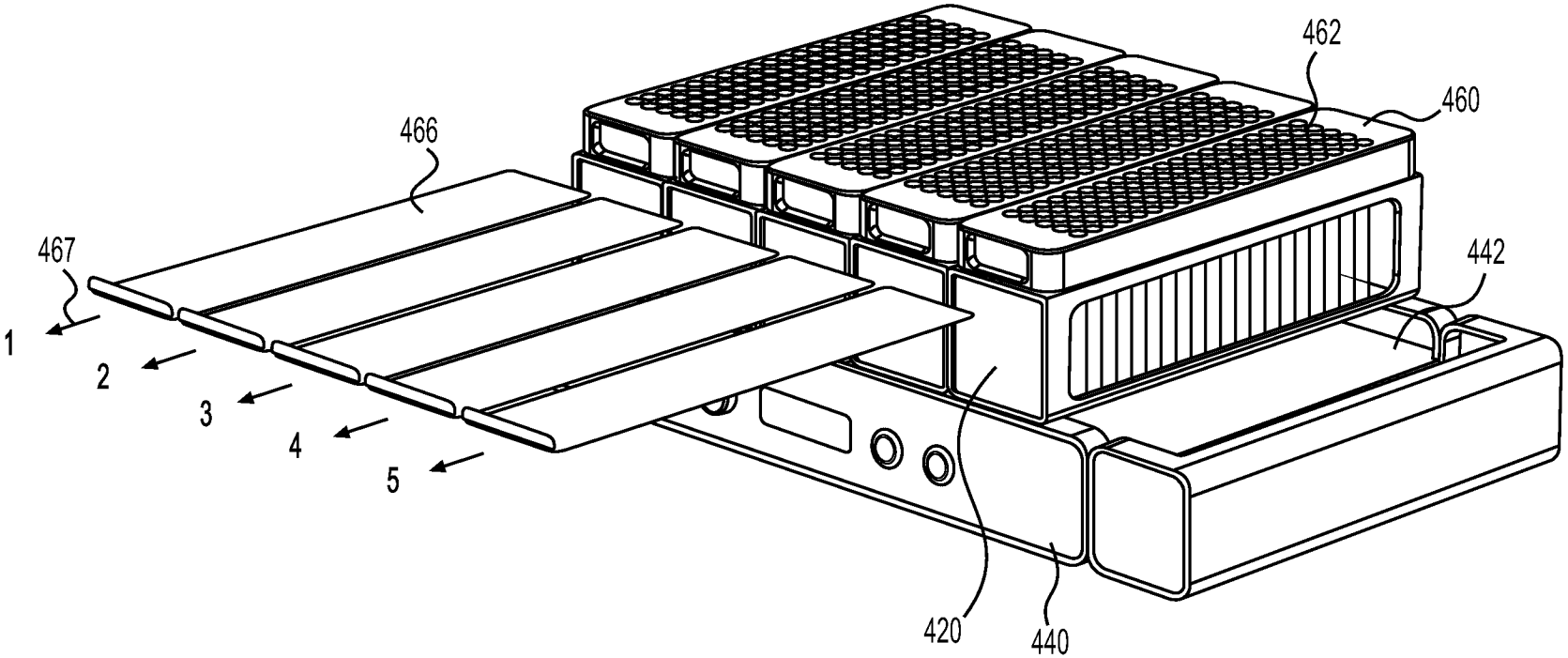

FIGS. 10D and 10E illustrate a series of material dispensing apparatuses 460. In the illustrated embodiment, each of the material dispensing apparatuses 460 has an array of material entry openings 462, an array of material egress openings 464 (not directly visible in FIGS. 10D and 10E), and a dispensing tray 466. In the illustrated embodiment, between the material entry openings and the material egress openings is either a single open material storage cavity, or a plurality of material storage cavities corresponding to each of the sets of openings 462, 464. In some embodiments, when the dispensing tray 466 is inserted to cover the material egress openings 464, material (e.g., herbal mixtures) may be added to the material dispensing apparatus 460 via the material entry openings 462, but material cannot be dispensed by the material dispensing apparatus 460 via the material egress openings 464. In some embodiments, when the dispensing tray 466 is removed, material may be dispensed by the material dispensing apparatus 460 via the material egress openings 464. As seen in FIG. 10D, five material dispensing apparatuses 460 are lowered into position (see arrows 461) over the five tube filling apparatuses 410 so that the openings 422, 462, 464 are in alignment. Since the dispensing trays 466 are fully inserted in FIG. 10D, material may not yet pass into the empty tubes 510 that are loaded into the filling apparatus. As seen in FIG. 10E, the dispensing trays 466 are removed (see arrows 467) and a metered amount of material passes from each of the material egress openings into the corresponding tubes 510 in the illustrated embodiment. Once all the desired filling assemblies 420 are loaded with the desired number of tubes 510 filled with material, the vibrating plate 442 of the base 440 may vibrate to settle some or all of the dispensed the material in the tubes 510.

Figure 10F:
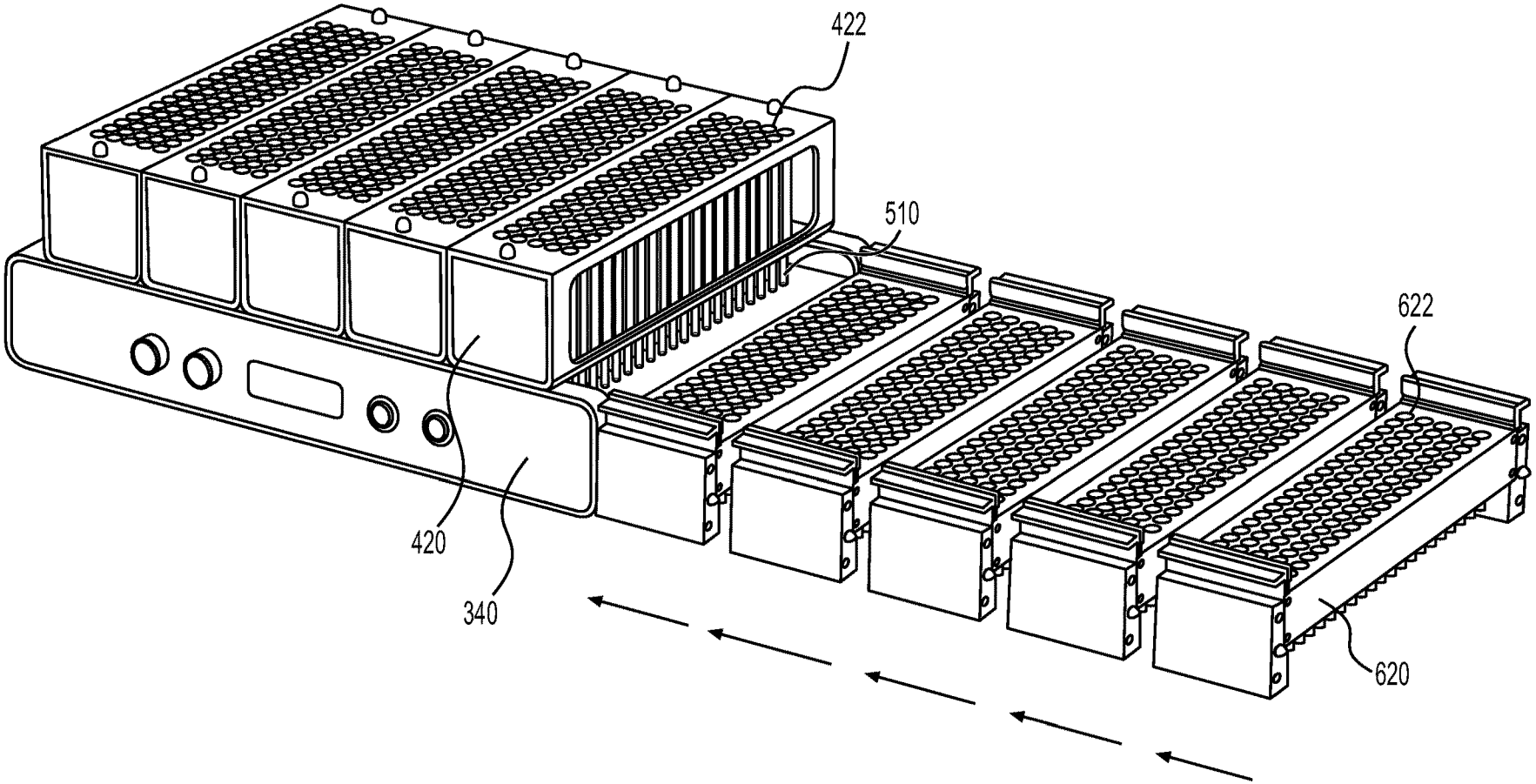
Figure 10G:
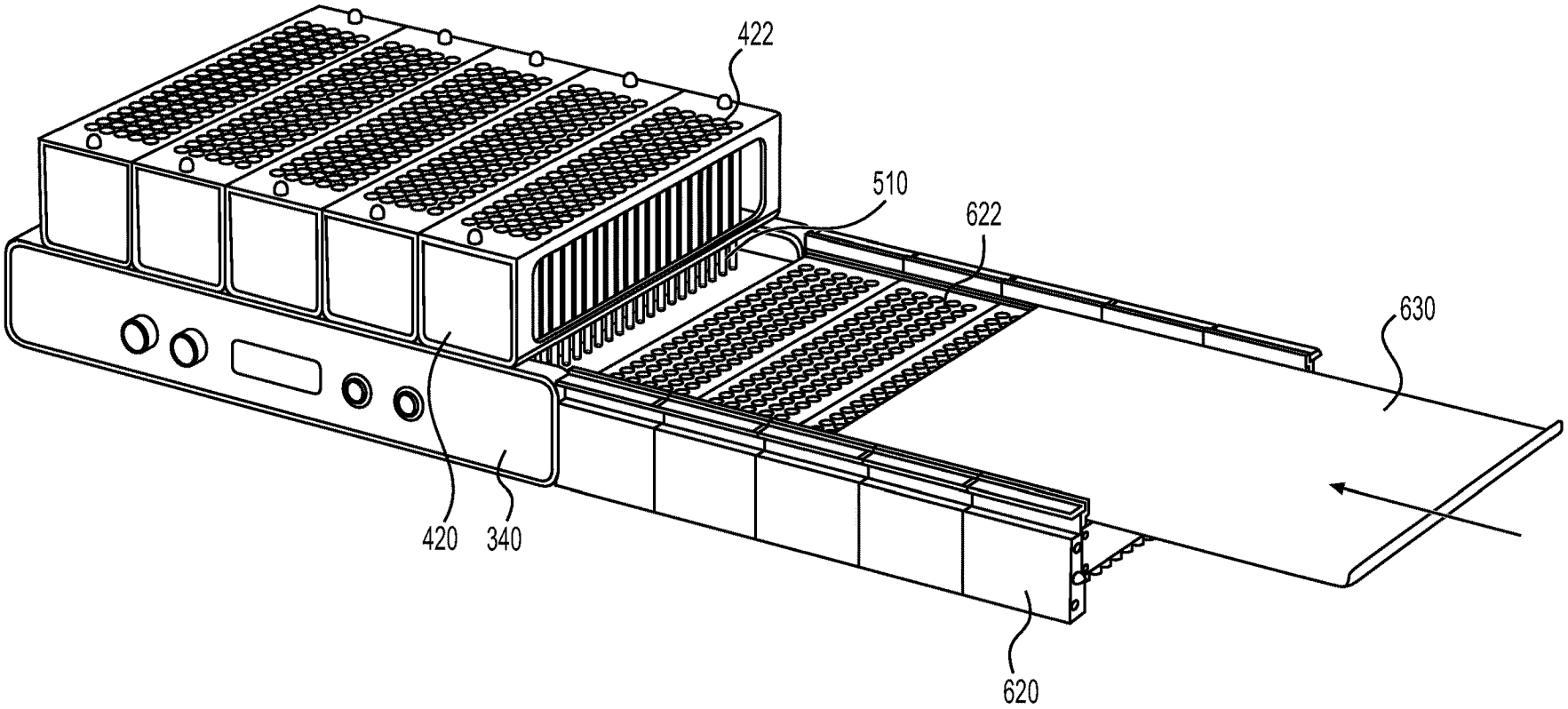
Figure 10H:
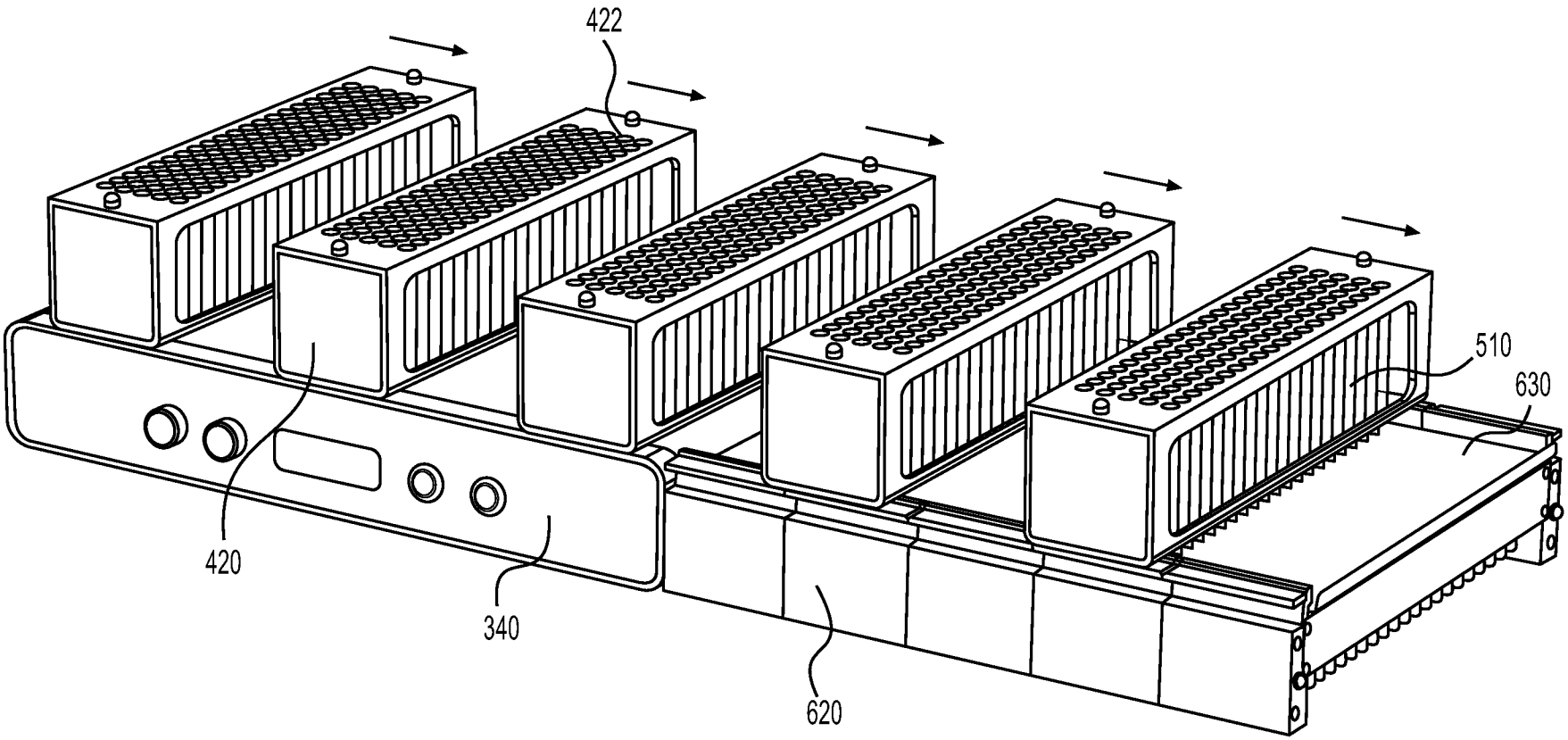
Figure 10I:
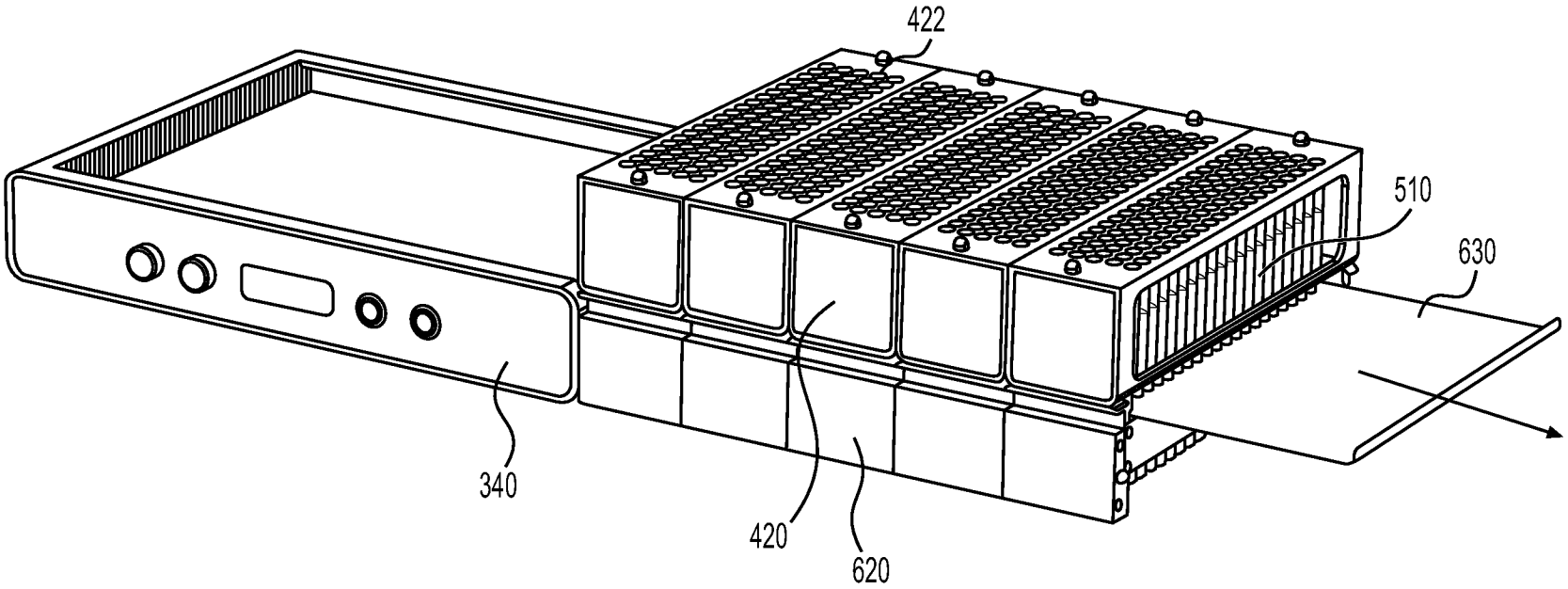
Figure 10J:
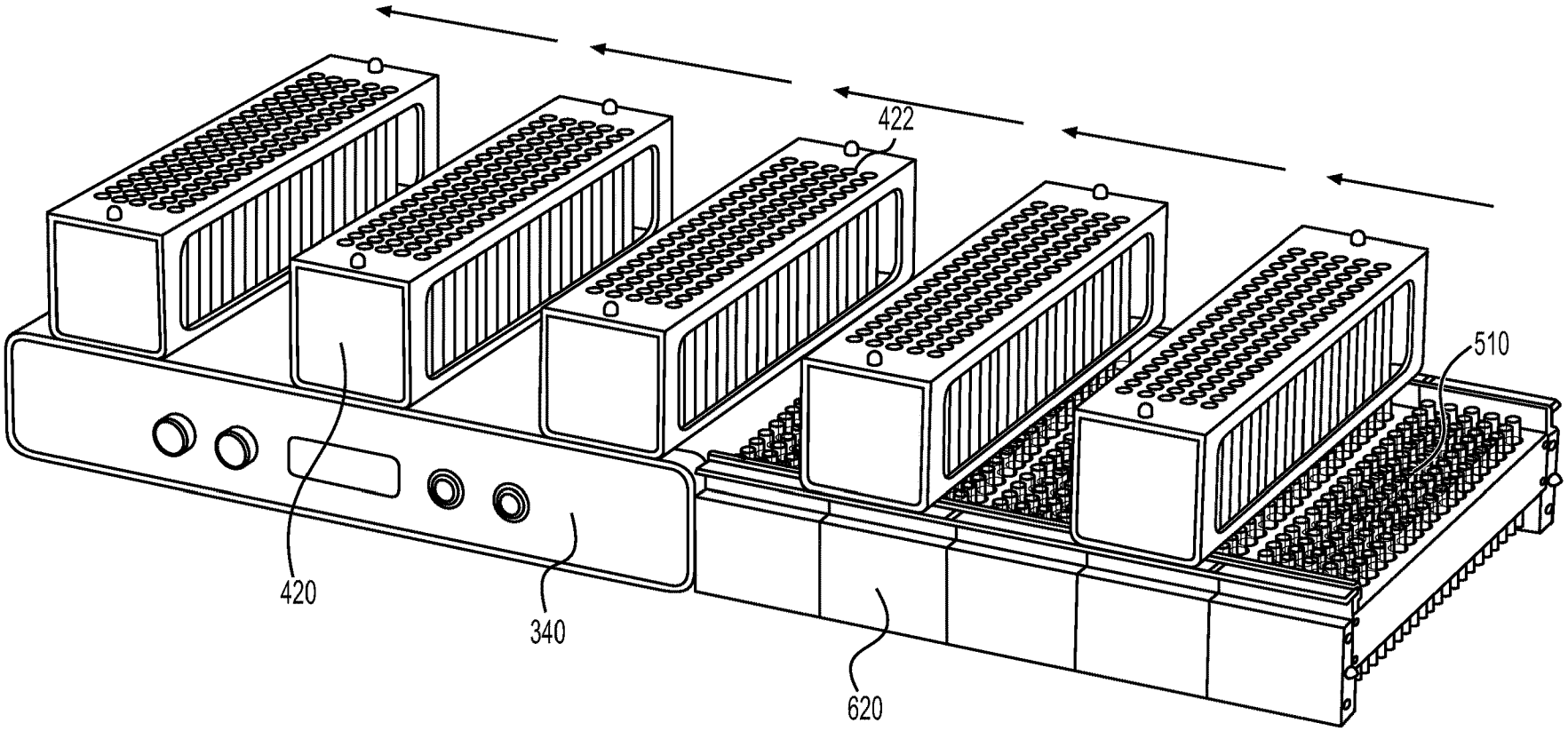

FIGS. 10F, 10G, 10H, 10I, and 10J illustrate the transfer of the tubes 510 filled with material from the filling assemblies 420 to weighing carriages 620 in one example embodiment. In the illustrated embodiment, each of the weighing carriages 620 includes a plurality of tube holder openings 622 arranged in an array that corresponds to the number of openings 422 in the filling assembly 420 (in the illustrated embodiment, a five by twenty array for a total of one hundred stacks of tubes). Additionally, the weighing carriages 620 may include features such as the tube holder module 150 and tube closing module 154 of the tube sealing apparatus 152 that is described above and depicted in FIGS. 6 and 7. As seen in FIG. 10F, five weighing carriages 620 are slid up to the side of the base 440. As seen in FIG. 10G, once the weighing carriages 620 are connected in alignment to each other and the base 440, a transfer tray 630 may be slid across the surface of the weighing carriages 620 so as to cover the tube holder openings 622. As seen in FIG. 10H, the filling assemblies 420 may be slid across the base 440 and the transfer tray 630 until each of the filling assemblies 420 is positioned above a corresponding weighing carriage 620 such that the openings 422, 622 are in alignment. As seen in FIG. 10I, when the transfer tray 630 is withdrawn, the tubes 510 filled with material may pass from the openings 422 into the tube holder openings 622 where the tubes 510 are held in place. As seen in FIG. 10J, the empty filling assemblies 420 may be slid away to leave individual weighing carriages 620 filled with tubes 510 of material ready for weighing.

Figure 10K:
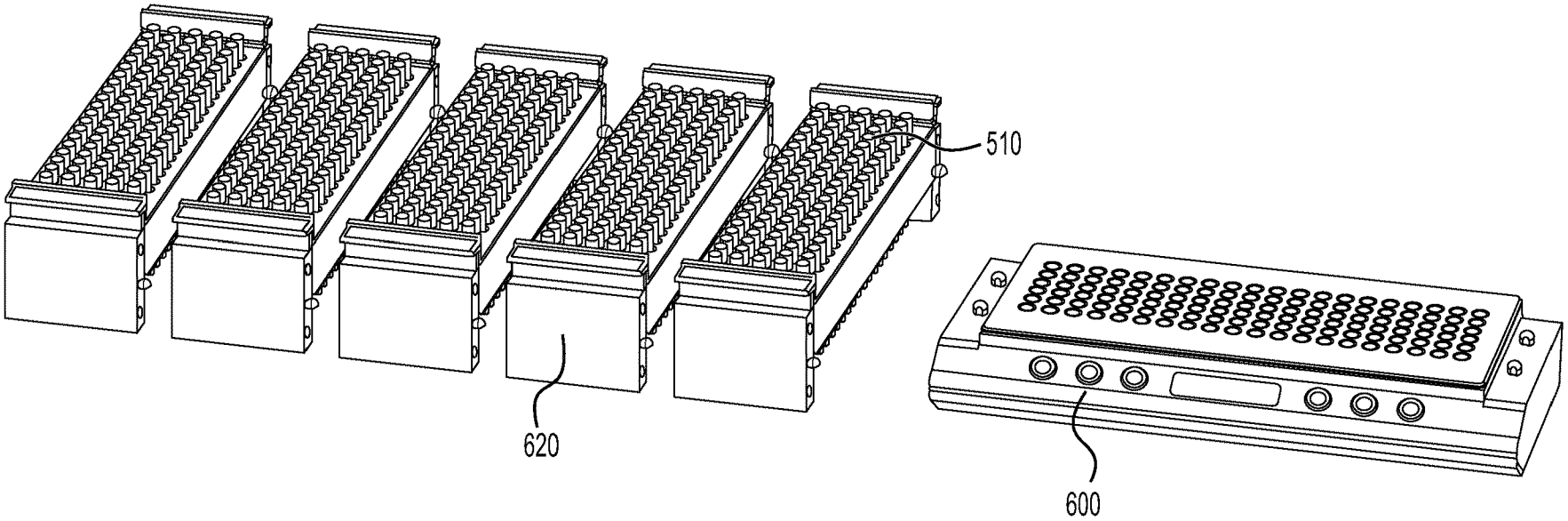

FIG. 10K illustrates weighing apparatus 600 configured to receive a weighing carriage 620 so that the each of the individually held tubes 510 of material may be independently and simultaneously weighed for quality assurance. The features and components of the weighing apparatus 600 may be similar to those of the weighing apparatus 1000 described above and depicted in FIGS. 8A through 8U.

It should be noted that the products and/or processes disclosed may be used in combination or separately. Additionally, exemplary embodiments are described with reference to the accompanying drawings. Wherever convenient, the same reference numbers are used throughout the drawings to refer to the same or like parts. While examples and features of disclosed principles are described herein, modifications, adaptations, and other implementations are possible without departing from the spirit and scope of the disclosed embodiments. It is intended that the prior detailed description be considered as exemplary only, with the true scope and spirit being indicated by the following claims.

The examples presented herein are for purposes of illustration, and not limitation. Further, the boundaries of the functional building blocks have been arbitrarily defined herein for the convenience of the description. Alternative boundaries can be defined so long as the specified functions and relationships thereof are appropriately performed. Alternatives (including equivalents, extensions, variations, deviations, etc., of those described herein) will be apparent to persons skilled in the relevant art(s) based on the teachings contained herein. Such alternatives fall within the scope and spirit of the disclosed embodiments. Also, the words "comprising," "having," "containing," and "including," and other similar forms are intended to be equivalent in meaning and be open ended in that an item or items following any one of these words is not meant to be an exhaustive listing of such item or items, or meant to be limited to only the listed item or items. It must also be noted that as used herein and in the appended claims, the singular forms "a," "an," and "the" include plural references unless the context clearly dictates otherwise.

What is claimed is:

1. A tube loading system comprising:

a tube loading apparatus including a frame, an upper slider connected to the frame, a lower slider connected to the frame, one or more guide tubes extending between the upper slider and the lower slider, and at least one actuator configured to control the positions of the upper slider and the lower slider;

a tube filling apparatus configured to detachably connect to the tube loading apparatus, the tube filling apparatus including a base and a filling assembly connected to the base, the filling assembly configured to receive one or more tubes from the tube loading apparatus for filling with material;

a tube sealing apparatus configured to detachably connect to the tube filling apparatus, the tube sealing apparatus configured to receive the one or more tubes from the tube filling apparatus and seal the one or more tubes closed preventing the material from leaving the one or more tubes; and a weighing apparatus configured to detachably connect to the tube sealing apparatus, the weighing apparatus configured to individually weigh each of the one or more tubes.

2. The tube loading system of claim 1:

wherein the filling assembly includes (i) a plurality of tube recesses each configured to receive the one or more tubes from the tube loading apparatus for filling with the material, and (ii) a vibration plate positioned between the base and the received one or more tubes, the vibration plate configured to move independently from the base and settle the material filled in the one or more tubes; and wherein the tube sealing apparatus includes: (i) a tube holder module including a plurality of openings, each opening surrounded by one or more flanges, and (ii) a tube closing module including a plurality of seal chambers configured to receive and seal the one or more tubes.

3. The tube loading system of claim 2, wherein the one or more guide tubes in the tube loading apparatus, the plurality of tube recesses in the filling assembly, and the plurality of openings in the tube holder module are aligned to pass the one or more tubes therebetween.

4. The tube loading system of claim 1, wherein the one or more guide tubes are configured to pass the one or more tubes from the upper slider to the lower slider; and the at least one actuator is connected to the upper slider and the lower slider and is further configured to control movement of the upper slider and the lower slider such that a position of the upper slider and the lower slider transition between a first position and a second position;

wherein in the first position, the upper slider is configured receive the one or more tubes and the one or more tubes are prevented from passing from the upper slider to the lower slider; and wherein in the second position, the upper slider is prevented from receiving the one or more tubes and the lower slider is configured to receive the one or more tubes from the upper slider.

5. The tube loading system of claim 4, wherein the at least one actuator is pivotably connected to the frame and configured to rotate with respect to the frame.

6. The tube loading system of claim 4, wherein rotational movement of the at least one actuator moves the upper slider and the lower slider between the first position and the second position.

7. The tube loading system of claim 1, wherein the tube filling assembly includes:

a plurality of tube recesses each configured to receive the one or more tubes from the tube loading apparatus for filling with the material; and a vibration plate positioned between the base and the received one or more tubes, the vibration plate configured to move independently from the base and settle the material filled in the one or more tubes.

8. The tube loading system of claim 1, wherein the tube sealing apparatus includes:

a tube holder module including a plurality of openings, each opening surrounded by one or more flanges; and a tube closing module including a plurality of seal chambers configured to receive and seal the one or more tubes.

9. The tube loading system of claim 1, wherein the tube sealing apparatus includes:

a tube holder module, the tube holder module comprising:

an upper plate and a lower plate separated by one or more spacers;

a plurality of openings in the upper plate;

a plurality of flanges surrounding the plurality of openings in the upper plate, the plurality of flanges having an open position that allows tubes to be loaded into the openings and a closed position that holds loaded tubes in the openings;

a tube closing module comprising:

one or more seal chambers, each seal chamber having one or more teeth and a drive member;

one or more gear racks configured to contact each drive member and rotate the drive member thereby rotating the teeth of each seal chamber.

10. The tube loading system of claim 9, wherein the one or more gear racks concurrently rotates each of the one or more drive chambers to concurrently seal a plurality of tubes.

11. A tube loading method comprising:

loading at least one tube into a tube loading apparatus, the tube loading apparatus including a frame, an upper slider connected to the frame, a lower slider connected to the frame, one or more guide tubes extending between the upper slider and the lower slider, and at least one actuator configured to control the positions of the upper slide and the lower slider;

passing the at least one tube from the tube loading apparatus to a tube filling apparatus, the tube filling apparatus configured to detachably connect to the tube loading apparatus, the tube filling apparatus including a base and a filling assembly connected to the base, the filling assembly configured to receive the at least one tube from the tube loading apparatus for filling with material;

passing the at least one tube from the tube filling apparatus to a tube sealing apparatus, the tube sealing apparatus configured to detachably connect to the tube filling apparatus, the tube sealing apparatus configured to receive the at least one tube from the tube filling apparatus and seal the at least one tube closed preventing the material from leaving the at least one tube;

passing the at least one tube from the tube sealing apparatus to a weighing apparatus, the weighing apparatus configured to detachably connect to the tube sealing apparatus; and individually weighing each of the at least one tube on the weighing apparatus.

12. The tube loading method of claim 11:

wherein the filling assembly includes (i) a plurality of tube recesses each configured to receive the at least one tube from the tube loading apparatus for filling with the material, and (ii) a vibration plate positioned between the base and the received at least one tube, the vibration plate configured to move independently from the base and settle the material filled in the at least one tube; and wherein the tube sealing apparatus includes: (i) a tube holder module including a plurality of openings, each opening surrounded by one or more flanges, and (ii) a tube closing module including a plurality of seal chambers configured to receive and seal the at least one tube.

13. The tube loading method of claim 12, wherein the one or more guide tubes, the plurality of tube recesses in the filling assembly, and the plurality of openings in the tube holder module are aligned to pass the at least one tube therebetween.

14. The tube loading method of claim 11, wherein the one or more guide tubes are configured to pass the at least one tube from the upper slider to the lower slider; and the at least one actuator is connected to the upper slider and the lower slider and is further configured to control movement of the upper slider and the lower slider such that a position of the upper slider and the lower slider transition between a first position and a second position;

wherein in the first position, the upper slider is configured receive the at least one tube and the at least one tube is prevented from passing from the upper slider to the lower slider; and wherein in the second position, the upper slider is prevented from receiving the at least one tube and the lower slider is configured to receive the at least one tube from the upper slider.

15. The tube loading method of claim 14, wherein the at least one actuator is pivotably connected to the frame and configured to rotate with respect to the frame.

16. The tube loading method of claim 14, wherein rotational movement of the at least one actuator moves the upper slider and the lower slider between the first position and the second position.

17. The tube loading method of claim 11, wherein the filling assembly includes:

a plurality of tube recesses each configured to receive the at least one tube from the tube loading apparatus for filling with the material; and a vibration plate positioned between the base and the received at least one tube, the vibration plate configured to move independently from the base and settle the material filled in the at least one tube.

18. The tube loading method of claim 11, wherein the tube sealing apparatus includes:

a tube holder module including a plurality of openings, each opening surrounded by one or more flanges; and a tube closing module including a plurality of seal chambers configured to receive and seal the at least one tube.

19. The tube loading method of claim 11, wherein the tube sealing apparatus includes:

a tube holder module, the tube holder module comprising:

an upper plate and a lower plate separated by one or more spacers;

a plurality of openings in the upper plate;

a plurality of flanges surrounding the plurality of openings in the upper plate, the plurality of flanges having an open position that allows tubes to be loaded into the openings and a closed position that holds loaded tubes in the openings;

a tube closing module comprising:

one or more seal chambers, each seal chamber having one or more teeth and a drive member;

one or more gear racks configured to contact each drive member and rotate the drive member thereby rotating the teeth of each seal chamber.

20. The tube loading method of claim 19, wherein the one or more gear racks concurrently rotates each of the one or more drive chambers to concurrently seal a plurality of tubes.

* * * * *